US009971275B2

(12) United States Patent
Kidaka

(10) Patent No.: US 9,971,275 B2
(45) Date of Patent: May 15, 2018

(54) IMAGE FORMING APPARATUS

(71) Applicant: CANON KABUSHIKI KAISHA, Tokyo (JP)

(72) Inventor: Hiroyuki Kidaka, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/585,440

(22) Filed: May 3, 2017

(65) Prior Publication Data

US 2017/0322503 A1 Nov. 9, 2017

(30) Foreign Application Priority Data

May 6, 2016 (JP) ..... 2016-093354

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS 6,058,275 A * 5/2000 Kodama ..... G03G 15/065 399/46
6,459,862 B1 * 10/2002 Sakemi ..... G03G 15/065 399/270
6,941,095 B2 * 9/2005 Kidaka ..... G03G 15/065 399/149
7,970,310 B2 6/2011 Kidaka
8,340,553 B2 12/2012 Kidaka
8,588,653 B2 11/2013 Kidaka et al.
8,731,440 B2 5/2014 Makino et al.
9,268,248 B2 2/2016 Makino et al.
2005/0180777 A1 * 8/2005 Kidaka ..... G03G 21/00 399/129
2016/0170323 A1 6/2016 Makino et al.

FOREIGN PATENT DOCUMENTS

JP H08-328364 A 12/1996
JP 2001-194876 A 7/2001
JP 2010-250051 A 11/2010

OTHER PUBLICATIONS

Hiroyuki Kidaka, U.S. Appl. No. 15/585,467, filed May 3, 2017, Kidaka (Pub No. US 2017/0322502 A1) Pub Date Nov. 9, 2017.

* cited by examiner

*Primary Examiner* — Rodney Bonnette
(74) *Attorney, Agent, or Firm* — Fitzpatrick, Cella, Harper & Scinto

(57) ABSTRACT

An image forming apparatus includes a photosensitive member, a charging member, an exposure member, a rotatable developer carrying member, a voltage source, and a controller configured to control the voltage source so that when a thickness of the surface layer of the photosensitive member is a first thickness, a developing bias voltage including an oscillating portion having an oscillating voltage and a rest portion having a substantially constant voltage alternately repeated is outputted. When the thickness of the surface layer of the photosensitive member is a second thickness smaller than the first thickness, a developing bias voltage in which the rest portion is not included or is shorter than the rest portion when the thickness of the surface layer is the first thickness is outputted.

7 Claims, 17 Drawing Sheets

(a)

(b)

| CHARGING BIAS APPLICATION TIME | ESTIMATED LAYER THICKNESS | DEVELOPING BIAS WAVEFORM |
|---|---|---|
| ≤ 70 HOURS | ≥ 5 μm | BLANK TIME=8t |
| > 70 HOURS & ≤ 208 HOURS | ≥ 3 μm & < 5 μm | BLANK TIME=6t |
| > 208 HOURS | < 3 μm | BLANK TIME=0 (RCTNGLR WAVE) |

(a)

(b)

| ESTIMATED LAYER THICKNESS | DEVELOPING BIAS WAVEFORM |
|---|---|
| ≥ 5 μm | BLANK TIME=8t |
| ≥ 3 μm & < 5 μm | BLANK TIME=6t |
| < 3 μm | BLANK TIME=0 (RCTNGLR WAVE) |

(a)

(b)

| A. W. C. (PER 1kg-DRY AIR) | DEVELOPING BIAS WAVEFORM |
|---|---|
| ≤ 5g | BLANK TIME=0 (RCTNGLR WAVE) |
| > 5g & ≤ 10g | BLANK TIME=6t |
| > 10g | BLANK TIME=8t |

(a)

(b)

| INJECTION CURRENT AMOUNT | DEVELOPING BIAS WAVEFORM |
|---|---|
| < 0.5 μA | BLANK TIME=0 (RCTNGLR WAVE) |
| ≥ 0.5 μA & < 1 μA | BLANK TIME=6t |
| ≥ 1 μA | BLANK TIME=8t |

(a)

(b)

| CHARGING BIAS APPLICATION TIME | ESTIMATED LAYER THICKNESS | ABSOLUTE WATER CONTENT | | |
|---|---|---|---|---|
| | | ≤ 5 g | > 5g & ≤ 10g | > 10g |
| ≤ 70 HOURS | ≥ 5 μm | BLANK TIME= 6t | BLANK TIME= 8t | BLANK TIME= 8t |
| > 70 HOURS & ≤ 208 HOURS | ≥ 3 μm & < 5μm | BLANK TIME=0 (RCTNGLR) | BLANK TIME=0 (RCTNGLR) | BLANK TIME= 8t |
| > 208 HOURS | < 3 μm | BLANK TIME=0 (RCTNGLR) | BLANK TIME=0 (RCTNGLR) | BLANK TIME= 6t |

(a)

(b)

| ESTIMATED LAYER THICKNESS | INJECTION CURRENT AMOUNT | | |
|---|---|---|---|
| | < 0.5 μA | ≥ 0.5 μA & <1 μA | ≥ 1 μA |
| ≥ 5 μm | BLANK TIME=6t | BLANK TIME=8t | BLANK TIME=8t |
| ≥ 3 μm & < 5 μm | BLANK TIME=0 (RCTNGLR WAVE) | BLANK TIME=0 (RCTNGLR WAVE) | BLANK TIME=8t |
| < 3 μm | BLANK TIME=0 (RCTNGLR WAVE) | BLANK TIME=0 (RCTNGLR WAVE) | BLANK TIME=6t |

IMAGE FORMING APPARATUS

FIELD OF THE INVENTION AND RELATED ART

The present invention relates to an image forming apparatus, such as a printer, a copying machine, a facsimile machine or a multi-function machine, using electrophotography.

In the image forming apparatus of an electrophotographic type, an electrostatic latent image is formed on a photosensitive member electrically charged by a charging device and is developed into a toner image by supplying toner from a developing device. The developing device includes a developer carrying member rotating while carrying a developer containing the toner, and the toner is moved to the photosensitive member by applying a bias voltage (developing bias) to the developer carrying member. As the developing bias, a rectangular wave bias in the form of a DC component, of the same polarity as a charge polarity of the toner, biased with an AC component having a rectangular-wave shape is used in some instances.

On the other hand, Japanese Laid-Open Patent Application 2001-194876 discloses an image forming apparatus in which as the developing bias, a blank pulse bias in which an oscillating portion where an applied voltage is oscillated by the AC component and a rest portion where the applied voltage is kept substantially constant are alternately repeated (hereinafter referred to as a BP bias) is used. In the case where the BP bias is used, the applied voltage immediately before the applied voltage changes from the oscillating portion to the rest portion is controlled so as to have the same polarity as the charge polarity of the toner. It has been known that as a result, the toner carried on the developer carrying member is efficiently jumped (moved) toward the photosensitive member and thus an image density can be ensured while suppressing the DC contact of the developing bias to a low level.

Incidentally, there is a recording material in which a photosensitive layer is coated in an outer periphery side with a surface layer such as a resin material coating film. This surface layer is gradually abraded by repetition of an image forming operation, so that a thickness thereof becomes small. However, in a constitution using such a photosensitive member, when the BP bias was always used as the developing bias, the photosensitive member was early abraded in some cases. That is, under application of the BP bias, the toner deposited on a carrier is moved to the photosensitive member by the applied voltage of the oscillating portion, so that the carrier moves to the rest portion in an exposed state in some instances. At this time, due to a potential difference between the applied voltage of the rest portion and a potential of the photosensitive member in a non-image region, the carrier is deposited on the photosensitive member in some instances. Further, such carrier deposition tends to become more noticeable with a decreasing thickness of the surface layer of the photosensitive member, so that the carrier deposited on the photosensitive member caused further acceleration of the abrasion of the surface layer abraded to some extent.

On the other hand, in order to avoid the carrier deposition onto the photosensitive member, even when the rectangular wave bias was always used, the photosensitive member was abraded early for another reason in some cases. In the case where the rectangular wave bias is used as the developing bias, in order to ensure a certain image density, there is a need that a value of a DC component of the rectangular wave bias is made larger than a value of a DC component of the BP bias. Further, in order to avoid toner contamination (fog) in the non-image region, there is a need that a potential difference between the DC component of the rectangular wave bias and the potential of the photosensitive member in the non-image region is ensured to some extent. As a result, in the case where the rectangular wave bias is used, an amount of electric charge supplied to the photosensitive member by the charging device increases, so that a charge potential is set at a high level. However, a discharge amount by the charging device increased, and the surface layer of the photosensitive member was deteriorated by a discharge product generating with electric discharge, so that the abrasion of the photosensitive member was accelerated in some instances.

SUMMARY OF THE INVENTION

According to an aspect of the present invention, there is provided an image forming apparatus comprising: a photosensitive member including a photosensitive layer and a surface layer formed on an outer periphery side of the photosensitive layer; a charging member configured to electrically charge a surface of the photosensitive member by being supplied with a charging bias voltage; an exposure member configured to expose the photosensitive member to light to form an electrostatic latent image; a rotatable developer carrying member configured to carry a developer containing toner; a voltage source configured to apply, to the developer carrying member, a developing bias voltage including a DC component and an AC component to develop the electrostatic latent image on the photosensitive member with the toner; and a controller configured to control the voltage source so that when a thickness of the surface layer of the photosensitive member is a first thickness, a developing bias voltage including an oscillating portion having an oscillating voltage and a rest portion having a substantially constant voltage alternately repeated is outputted, and so that when the thickness of the surface layer of the photosensitive member is a second thickness smaller than the first thickness, a developing bias voltage in which the rest portion is not included or is shorter than the rest portion when the thickness of the surface layer is the first thickness is outputted.

According to another aspect of the present invention, there is provided an image forming apparatus comprising: a photosensitive member including a photosensitive layer and a surface layer formed on an outer periphery side of the photosensitive layer; a charging member configured to electrically charge a surface of the photosensitive member by being supplied with a charging bias voltage; an exposure member configured to expose the photosensitive member to light to form an electrostatic latent image; a rotatable developer carrying member configured to carry a developer containing toner; a voltage source configured to apply, to the developer carrying member, a developing bias voltage including a DC component and an AC component to develop the electrostatic latent image on the photosensitive member with the toner; and a controller configured to control the voltage source so that when a current application time of the charging bias voltage is a first length, a developing bias voltage including an oscillating portion having an oscillating voltage and a rest portion having a substantially constant voltage alternately repeated is outputted, and so that when the current application time is a second length longer than the first length, a developing bias voltage in which the rest portion is not included or is shorter than the rest portion when the current application time is the first length is outputted.

According to a further aspect of the present invention, there is provided an image forming apparatus comprising: a photosensitive member including a photosensitive layer and a surface layer formed on an outer periphery side of the photosensitive layer; a charging member configured to electrically charge a surface of the photosensitive member by being supplied with a charging bias voltage; an exposure member configured to expose the photosensitive member to light to form an electrostatic latent image; a rotatable developer carrying member configured to carry a developer containing toner; a voltage source configured to apply, to the developer carrying member, a developing bias voltage including a DC component and an AC component to develop the electrostatic latent image on the photosensitive member with the toner; and a controller configured to control the voltage source so that when an electrostatic capacity of the surface layer of the photosensitive member is a first electrostatic capacity, a developing bias voltage including an oscillating portion having an oscillating voltage and a rest portion having a substantially constant voltage alternately repeated is outputted, and so that when the electrostatic capacity of the surface layer of the photosensitive member is a second electrostatic capacity larger than the first electrostatic capacity, a developing bias voltage in which the rest portion is not included or is shorter than the rest portion when the electrostatic capacity of the surface layer is the first electrostatic capacity is outputted.

Further features of the present invention will become apparent from the following description of exemplary embodiments with reference to the attached drawings.

DESCRIPTION OF EMBODIMENTS

In the following, an image forming apparatus according to an embodiment of the present invention will be described with reference to the drawings. First, a structure of the image forming apparatus and a problem in the prior art will be described and then details of respective embodiments will be described.

Embodiment 1

Image Forming Apparatus

Figure 1:
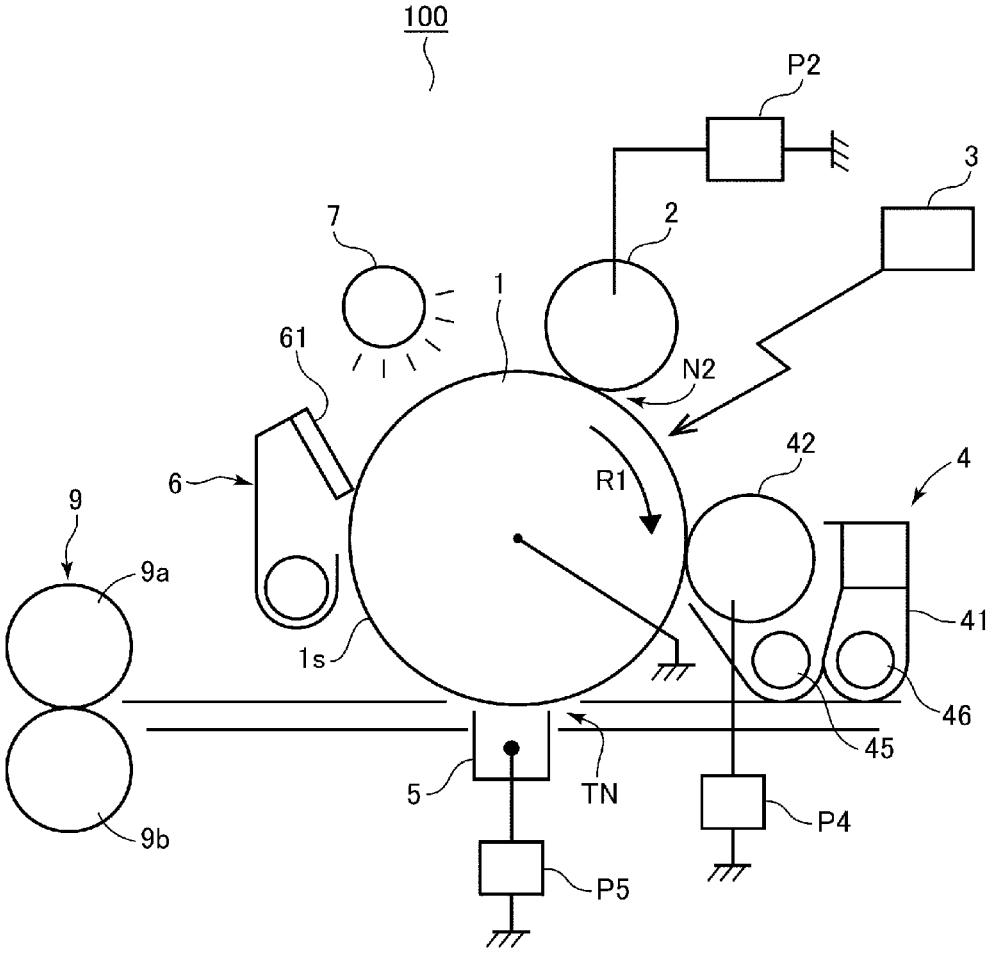
FIG. 1 is a schematic view showing a structure of an image forming apparatus.

An image forming apparatus 100 having a schematic structure shown in FIG. 1 is an image forming apparatus of an electrophotographic type in which a photosensitive drum 1 is provided as an image bearing member for bearing an electrostatic latent image. The photosensitive drum 1 is a cylindrical photosensitive member prepared by forming, on an outer peripheral surface of a shaft core which is grounded, a photosensitive layer formed of a photoconductive material such as an organic photoconductor (OPC). An outer peripheral surface side of the photosensitive layer is coated with a surface layer is formed of a high-hardness resin material or the like. The photosensitive drum 1 rotates in an arrow R1 direction at a predetermined process speed.

At a periphery of the photosensitive drum 1, a pre-exposure device 7, a charging roller 2, an exposure device 3, a developing device 4, a transfer device 5 and a cleaning device 6 are provided. The charging roller 2 as a charging means for electrically charging a surface of the photosensitive drum (photosensitive member) 1 is a charging member of a proximity discharge type in which the charging roller 2 contacts the surface of the photosensitive drum 1. To the charging roller 2, from a charging bias voltage consisting of a DC voltage or in the form of the DC voltage biased with an AC voltage (hereinafter referred to as a charging bias) is applied. The charging roller 2 to which the charging bias is applied supplies electric charges to the photosensitive drum 1 at a charging nip N2 while rotating in a direction in which the charging roller 2 is rotated by the photosensitive drum 1, and thus uniformly charges the surface of the photosensitive drum 1.

The exposure device 3 as an exposure means includes a light-emitting portion (not shown) such as a laser light source and a scanning optical system (not shown) for scanning the surface of the photosensitive drum 1 with light emitted from the light-emitting portion. The exposure device 3 exposes the photosensitive drum 1 to the light depending on image information, so that an electrostatic latent image is formed on the surface of the photosensitive drum 1.

The developing device 4 as a developing means for developing the electrostatic latent image into a toner image includes a developing container 41 for accommodating a developer and a developing sleeve 42 rotating while carrying the developer. In this embodiment, a two-component developer containing non-magnetic toner including a color component, and containing a magnetic carrier. This developer is circulated and fed inside the developing container 41 while being stirred by screws 45 and 46, and thus is in a state in which the toner and the carrier are triboelectrically charged. Incidentally, in this embodiment, the toner has a negative charge polarity, and the carrier has a positive charge polarity.

The developing sleeve 42 as the developer carrying member for carrying the developer is provided at an opening of the developing container 41 in a state in which the developing sleeve 42 is loosely fitted around an unshown magnet which is a magnetic field generating means. The developing sleeve 42 rotates while carrying the toner and the carrier attracted by a magnetic force of the magnet, and feeds the developer to a developer region which is an opposing region to the photosensitive drum 1. The developing sleeve 42 is supplied with a developing bias voltage (hereinafter referred to as a developing bias) by a developing bias voltage source P4 as a bias applying means, and thus supplies the toner to the photosensitive drum 1, so that the electrostatic latent image is developed into the toner image.

The toner image formed on the photosensitive drum 1 is transferred at a transfer portion TN onto a recording material by the transfer device 5. However, the recording material is a sheet-shaped recording medium such as a sheet, a plastic film or a cloth, and is fed to a transfer portion TN by an unshown feeding device. The transfer device 5 is, e.g., a charger of a corona discharge type, and transfers the toner image onto the recording material by being supplied with a bias voltage of an opposite polarity (positive polarity) to the charge polarity of the toner from a transfer bias voltage source P5. The recording material on which the toner image is transferred is fed to a fixing device 9 including a pressing roller 9*a* and an opposing roller 9*b*. The recording material is nipped by the pressing roller 9*a* and the opposing roller 9*b*, and heat and pressure are applied to the toner image, so that the toner image is fixed on the recording material. The recording material on which the toner image is fixed is discharged to an outside of an apparatus main assembly by an unshown discharging device.

Transfer residual toner remaining on the photosensitive drum 1 without being transferred onto the roller at the transfer portion TN and a deposited matter containing a discharge product generated by electric discharge of the charging roller 2 or the like are removed by the cleaning device 6. The cleaning device 6 includes a cleaning blade 61 and collects the deposited matter, scraped off by the cleaning blade 61, into an unshown collecting portion. The photosensitive drum 1 from which the deposited whether is removed is forcedly subjected to exposure to light and thus is discharged (charge-removed), so that the photosensitive drum 1 prepares for subsequent image formation.

Incidentally, the image forming apparatus in this embodiment was described as a monochromatic image forming apparatus, but the present invention is also applicable to image forming apparatuses other than the monochromatic image forming apparatus. For example, the image forming apparatus may also be an image forming apparatus of an intermediary transfer type in which the toner image is primary-transferred onto an intermediary transfer member such as an intermediary transfer belt, and then is secondary-transferred onto the recording material. Further, the image forming apparatus may also be a full-color image forming apparatus in which toner images of colors of cyan, magenta, yellow and black are formed by image forming units each including a photosensitive drum and then are transferred onto the recording material.

Voltage Source Constitution

Figure 2:
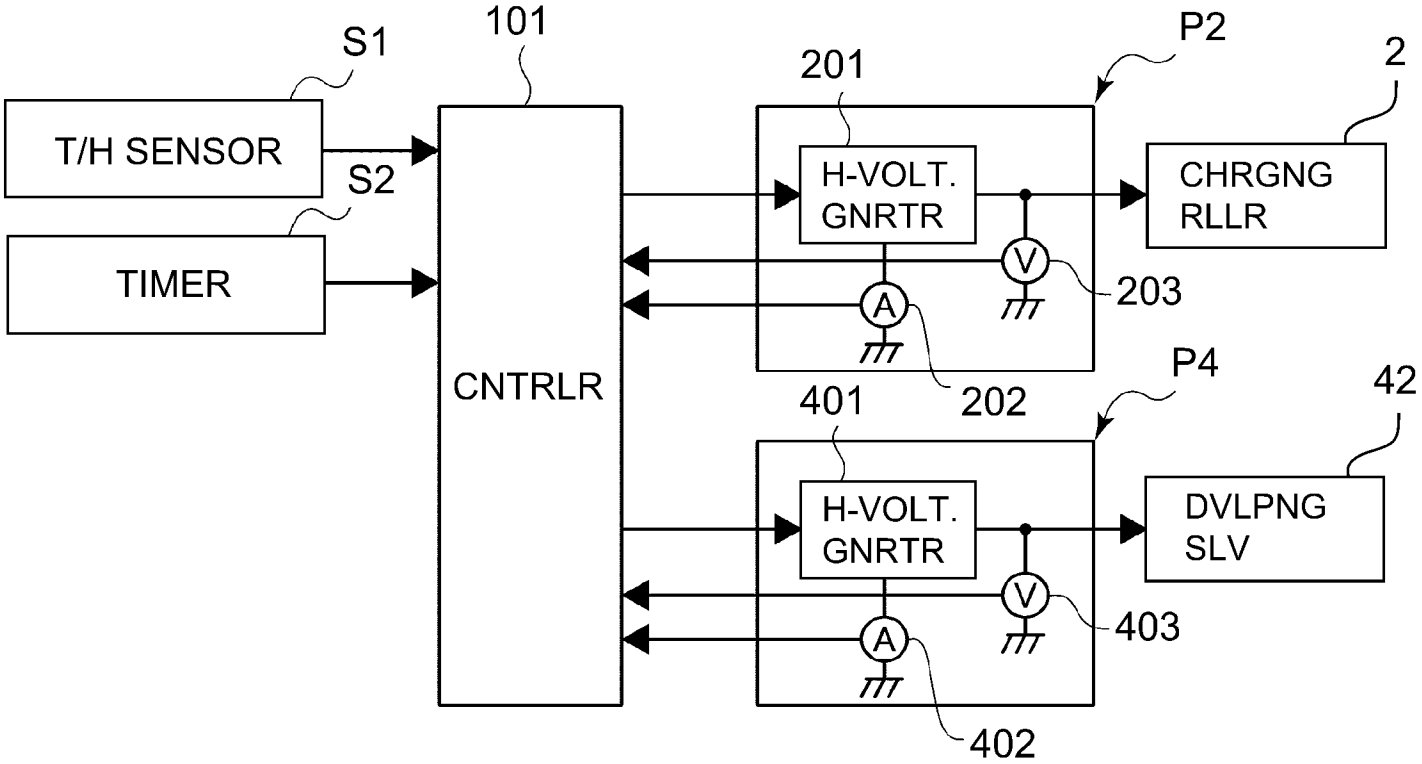
FIG. 2 is a block diagram showing a voltage source constitution of the image forming apparatus.

The charging bias voltage source P2 and the developing bias voltage source P4 shown in FIG. 2 include high-voltage source substrates provided in the apparatus main assembly of the image forming apparatus 100. The charging bias voltage source P2 includes a high-voltage generating circuit 201 for outputting a high voltage and outputs the charging bias to the charging roller 2 in accordance with a control signal from a controller 101 for controlling an operation of the image forming apparatus 100. The developing bias voltage source P4 includes a high-voltage generating circuit 401 for outputting a high voltage and outputs the developing bias to the developing sleeve 42 in accordance with a control signal from the controller 101. These high-voltage source substrates are provided with current detecting portions 202 and 402 for detecting output currents from the high voltage generating circuits 201 and 401, respectively, and voltage detecting portions 203 and 403 for detecting output voltages from the high voltage generating circuits 201 and 401, respectively.

Incidentally, the controller 101 controls, on the basis of detection signals of various sensors, operations of respective portions of the image forming apparatus 100 including the charging bias voltage source P2 and the developing bias voltage source P4. Such sensors include a temperature and humidity sensor S1 for detecting a temperature and a humidity of an inside of the apparatus, a timer S2 for clocking (counting a time), and the like.

Waveform of Developing Bias

Next, a waveform of the developing bias used in this embodiment will be described. As schematically shown in (a) of FIG. 3, the developing bias voltage source P4 applies a developing bias in the form of a DC component having a voltage value Vdc biased with an AC component having a peak-to-peak voltage Vpp. In this embodiment, a reverse development type is employed, and therefore, a dark-portion potential VD formed by the charging roller 2 has a negative polarity which is the same as the charge polarity of the toner and lowers to a light-portion potential VL by the exposure. The voltage value Vdc of the DC component of the developing bias is set at a value between the dark-portion potential VD and the light-portion potential VL.

A potential difference between the DC contact (Vdc) of the developing bias and the light-portion potential VL is called a developing contrast Vcont. With a larger developing contrast Vcont, a deposition amount of the toner in an exposure region of the photosensitive drum 1, i.e., an image density of the toner image formed by developing the electrostatic latent image, becomes higher. Further, a potential difference between the DC component (Vdc) of the developing bias and the dark-portion potential VD is called a fog-removing bias Vback. The toner deposited in a non-exposure region is moved back to the developing sleeve 42 by the action of the fog-removing bias Vback. For this reason, when the fog-removing bias Vback is larger, an effect of suppressing thin toner contamination (fog) in a non-image region (white background portion) is more enhanced.

Figure 3:
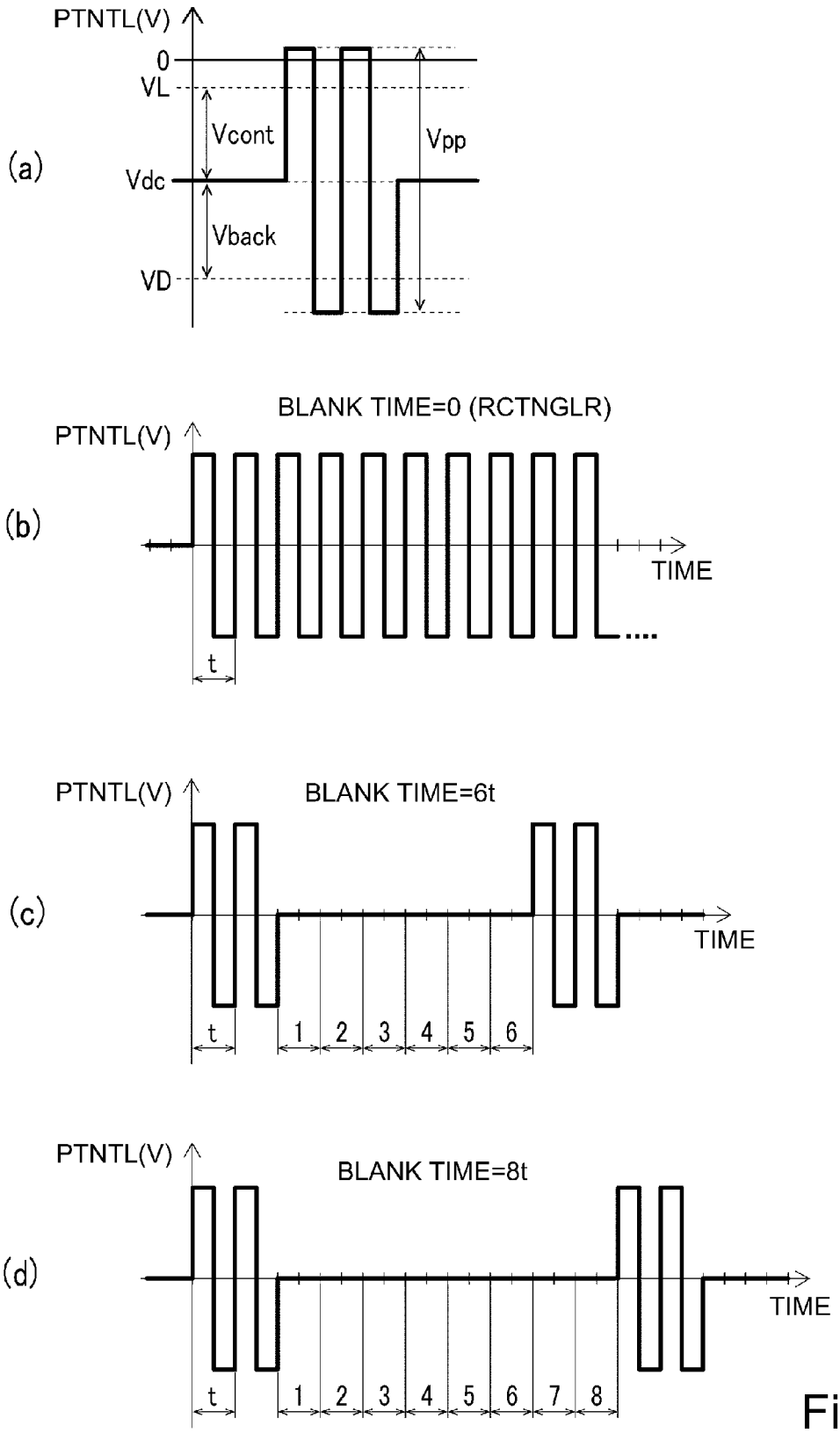
In FIG. 3, (a) is a schematic view showing a variable characterizing a waveform of a developing bias, (b) is a graph showing a rectangular wave bias, and (c) and (d) are graphs showing blank pulse biases (BP biases) different in length of a blank portion.

As shown in (b), (c) and (d) of FIG. 3, the developing bias voltage source P4 in this embodiment is capable of outputting three types of waveforms as the developing bias. A rectangular wave bias (rectangular bias) shown in (b) of FIG. 3 successively outputs a rectangular wave having the peak-to-peak voltage Vpp. This rectangular wave if 2-20 kHz in frequency, and the frequency thereof is set at 12 kHz, for example. Further, the peak-to-peak voltage is set at 2 kV, for example.

On the other hand, the BP biases shown in (c) and (d) of FIG. 3 alternately repeat an oscillating portion Ts consisting of a rectangular wave pulse and a blank portion Tb which is a rest portion where application of the AC component is at rest. In other words, an applied voltage at the blank portion Tb is kept substantially constant at the DC component (Vdc) of the developing bias. The BP bias of (c) of FIG. 3 is constituted by an oscillating portion (Ts=2 t) corresponding to 2 (cycle) periods in terms of a period t of the rectangular wave and a blank portion (Tb=6 t) corresponding to 6 periods. Further, the BP bias of (d) of FIG. 3 is constituted by the oscillating portion (Ts=2 t) corresponding to 2 periods in terms of the period t of the rectangular wave and a blank portion (Tb=8 t) corresponding to 8 periods.

Incidentally, as the period t of the BP bias and the peak-to-peak voltage Vpp, it is possible to use the same values as those of the rectangular wave bias, but the relationship and the voltage Vpp may also be set independently of those of the rectangular wave bias. Further, lengths of the oscillating portion and the blank portion are not limited to the above-described lengths, but the oscillating portion Ts may preferably be a length corresponding to 1-4 periods and the length of the blank portion Tb may preferably be 10 or less (0-10 t) in wave number in terms of the period of the rectangular wave.

Thus, in this embodiment, the BP bias in which the oscillating portion and the rest portion are alternately repeated and the rectangular wave bias including no rest portion are usable. In other words, the length of the rest portion between a certain oscillating portion and a subsequent oscillating portion is variable including zero. The BP bias shown in (c) of FIG. 3 is an example of a first developing bias voltage in which a blank portion time is not less than 6 t (not less than 6 periods), and the rectangular wave bias shown in (b) of FIG. 3 is an example of a second developing bias voltage including no rest portion. Further, the BP bias shown in (d) of FIG. 3 is an example of a third developing bias voltage including a rest portion longer than that of the first developing bias voltage.

Comparison of Waveforms of Developing Bias

Here, a general feature of the rectangular wave bias and the BP bias will be described using (a) and (b) of FIG. 4. However, in FIG. 4, (a) shows a relationship between the developing contrast and the image density in the case where the fog-removing contrast is a certain value. Further, in FIG. 4, (b) shows a relationship among the fog-removing contrast, a toner deposition amount on the non-image region and a carrier deposition amount on the photosensitive drum 1 in the case where the developing contrast is a certain value.

Referring to (a) of FIG. 3, the sum of the developing contrast Vcont and the fog-removing bias Vback equals a difference between the dark-portion potential VD and the light-portion potential VL. Accordingly, in order to increase one of the developing contrast and the fog-removing bias, there arises a need that the other is made small or an absolute value of the dark-portion potential is made large. However, when the dark-portion potential is increased, an amount of electric discharge between the charging roller 2 and the photosensitive drum 1 increases, so that a deterioration of the surface layer is of the photosensitive drum 1 by the discharge product is accelerated. For this reason, the developing contrast and the fog-removing bias may preferably be a small value as long as performances such as a quality of an output image and reduction in fog amount and carrier deposition amount are satisfied.

Figure 4:
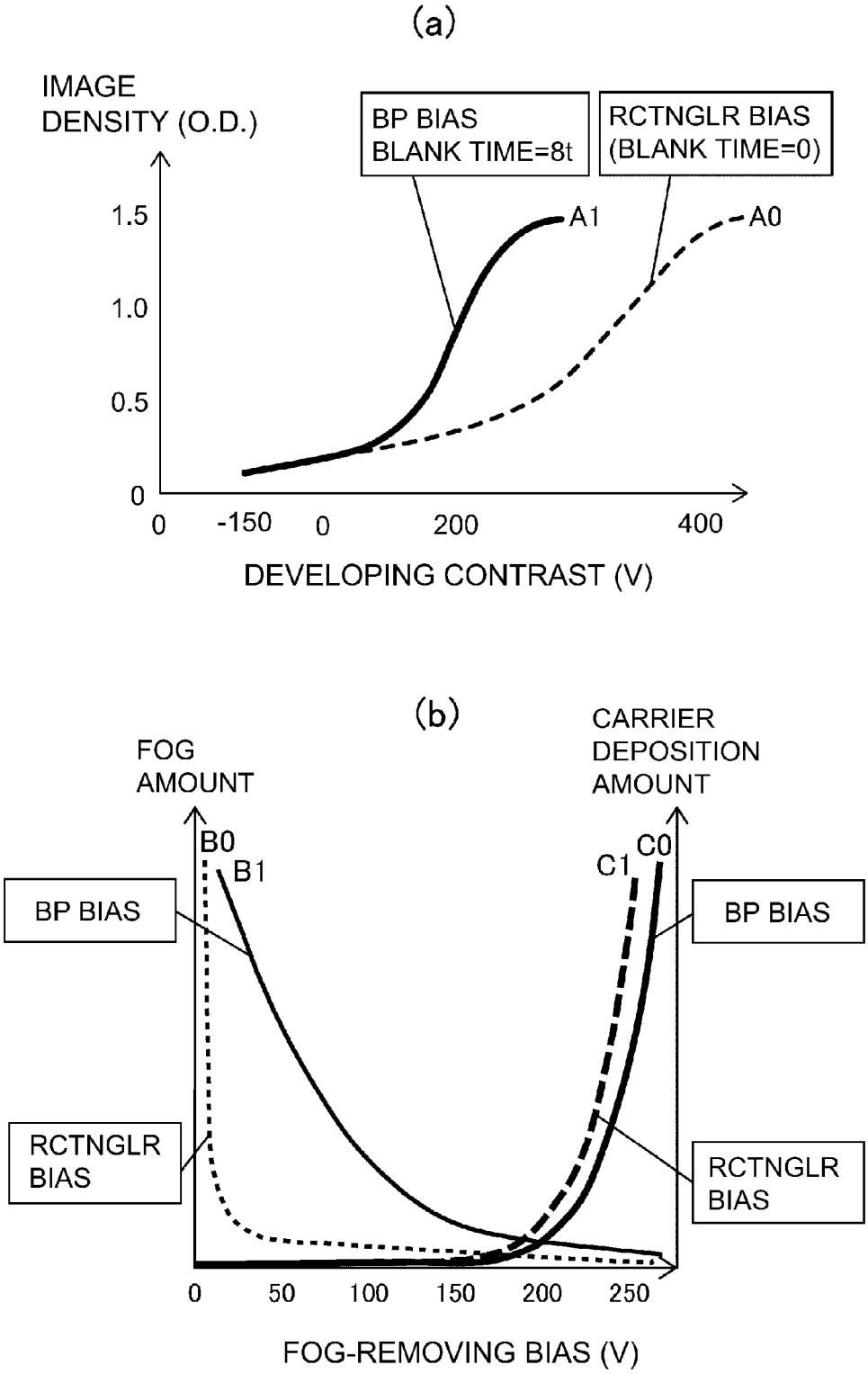
In FIG. 4, (a) is a graph showing a relationship between a developing contrast and an image density in the case where the rectangular wave bias and the BP bias are used, and (b) is a graph showing a relationship among a fog-removing bias, a fog amount and a carrier deposition amount in the case where the rectangular wave bias and the BP bias are used.

As shown in (a) of FIG. 4, in the case where the rectangular wave bias and the BP bias are compared with each other, it is known that the BP bias provides a higher image density after the development (A1>A0). This is because a voltage of the same polarity as the toner charge polarity is applied immediately before the blank portion Tb of the BP bias ((c) and (d) of FIG. 3) and therefore the toner jumps toward the photosensitive drum 1 at the blank portion Tb and thus leads to improvement of a toner coverage ratio. This means that in the case where the density of the output image is kept constant, a necessary developing contrast value of the BP bias is smaller than that of the rectangular wave bias.

On the other hand, as regards the fog-removing bias, the necessary developing contrast value of the rectangular wave bias is smaller than that of the BP bias in some cases. As shown in (b) of FIG. 4, in general, a fog amount in the case where the rectangular wave bias is used is smaller than a fog amount in the case where the BP bias is used (B1>B0). This is because in the case of the rectangular wave bias, the applied voltage of the opposite polarity to the toner charge polarity is frequently outputted, and therefore, the action of moving the fog toner back to the developing sleeve 42 acts on the fog toner. In the rectangular wave bias, this action of moving the toner back to the developing sleeve 42 works together with a toner scattering suppressing effect by the fog-removing bias itself, so that the fog amount is sufficiently reduced even when the fog-removing bias is a small value.

Further, as a common property of the rectangular wave bias and the BP bias, with a larger fog-removing bias, the amount of the carrier which is moved away from the developing sleeve 42 and which is deposited on the photosensitive drum 1 increases (C0, C1). This is because the carrier has the charge polarity opposite to the toner charge polarity, and therefore, with a larger fog-removing bias, the carrier is liable to jump toward an unexposed region of the photosensitive drum 1 with the dark-portion potential.

Thus, as regards a magnitude of the fog-removing bias, in general, the fog amount and the carrier deposition amount are in a trade-off relationship, and the fog-removing bias is set so that both of these abrasions are suppressed to tolerable ranges. However, a fog amount-reducing effect in the case where the rectangular wave bias is used is large (BO), and therefore a fog-removing bias range in which the fog amount and the carrier deposition amount are tolerable is broader for the rectangular wave bias than for the BP bias. That is, in the case of the rectangular wave bias, redundancy of a fog-removing bias settable range is larger than that in the case of the BP bias. For this reason, a value of the fog-removing bias necessary in the case where the rectangular wave bias is used is smaller than that in the case where the BP bias is used.

The image forming apparatus 100 in this embodiment determines a waveform of the developing bias in consideration of a thickness of the surface layer 1*s* of the photosensitive drum 1 in addition to the above-described feature of the rectangular wave bias and the BP bias.

Influence of Change in Surface Layer Thickness of Photosensitive Drum

In the following, an influence of a thickness of the surface layer 1*s* of the photosensitive drum 1 (hereinafter referred to as a film thickness since the surface layer l*s* is typically a resin material coating) will be described. The surface layer 1*s* is abraded with an increase in cumulative operation time of the image forming apparatus 100, so that the film thickness thereof gradually decreases. As an abrasion factor of the surface layer 1*s*, it is possible to cite sliding by the cleaning blade 61 and a deterioration of the surface layer 1*s* by the electric discharge of the charging roller 2. The cleaning blade 61 mechanically abrades the surface layer 1*s* with rotation of the photosensitive drum 1. The charging roller 2 generates the discharge product such as nitrogen oxide or ozone by the electric discharge under application of the charging bias. Then, the discharge product oxidizes the surface layer 1*s* and lowers durability of the surface layer 1*s*, and thus accelerates the abrasion by the cleaning blade or the like.

With smaller film thickness of the surface layer 1*s*, a value of electrostatic capacity of the photosensitive drum 1 becomes larger. By a change in electrostatic capacity of the photosensitive drum 1, under application of the rectangular wave bias and the BP bias, the influences shown in Table 1 below appear. In Table 1, "○" represents a preferred evaluation, "◎" represents a particularly preferred evaluation, and "Δ" represents a relatively unpreferred evaluation. In the following, details of evaluations shown in Table 1 will be described in turn with reference to FIG. 5 and (a) and (b) of FIG. 6.

TABLE 1

| | Item | WRB*1 | BPB*2 |
|---|---|---|---|
| (IS*3) | DP*4 | Δ | ◎ |
| SLT:L | FOG | ◎ | ○ |
| EC:S | CD*5 | ◎ | ○ |
| | CDA*6 | US*7 | ○ |

TABLE 1-continued

| | Item | WRB*1 | BPB*2 |
|---|---|---|---|
| (AS*8) | DP*4 | ○ | ◎ |
| SLT:S | FOG | ◎ | Δ |
| EC:L | CD*5 | ◎ | US*7 |
| | CDA*6 | ○ | ◎ |

*1"WRB" is the rectangular wave bias.

*2"BPB" is the BP bias.

*3"IS" is an initial state. "SLT" is the surface layer thickness, and "EC" is the electrostatic capacity. "L" is large, and "S" is small.

*4"DP" is the developing property.

*5"CD" is the carrier deposition.

*6"CDA" is the charging discharge amount.

*7"US" is an unsuitable state (evaluation).

*8"AS" is an abraded state. "SLT" is the surface layer thickness, and "EC" is the electrostatic capacity. "S" is small, and "L" is large.

Figure 5:
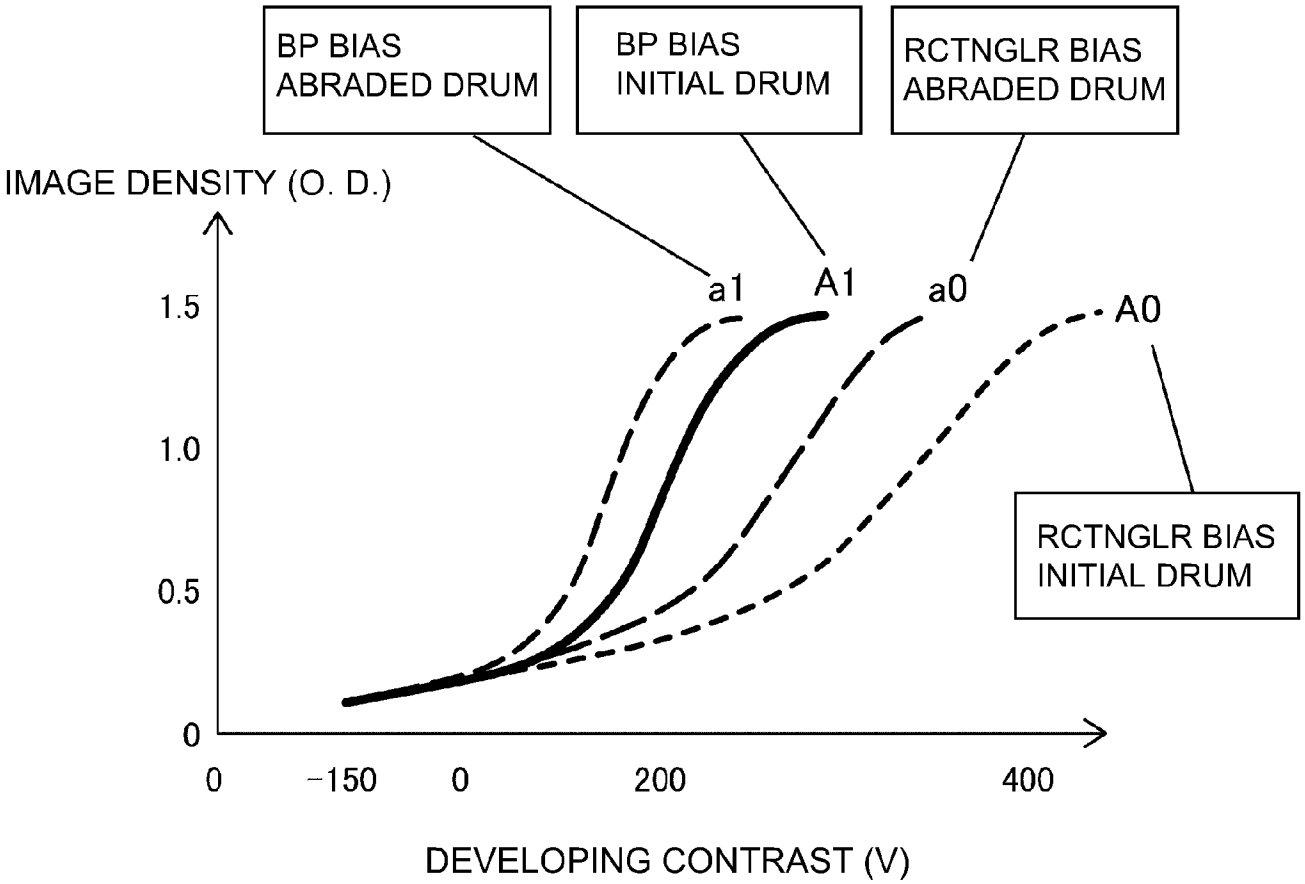
FIG. 5 is a graph showing an influence of abrasion of a deposit on a developing property.
Figure 6:
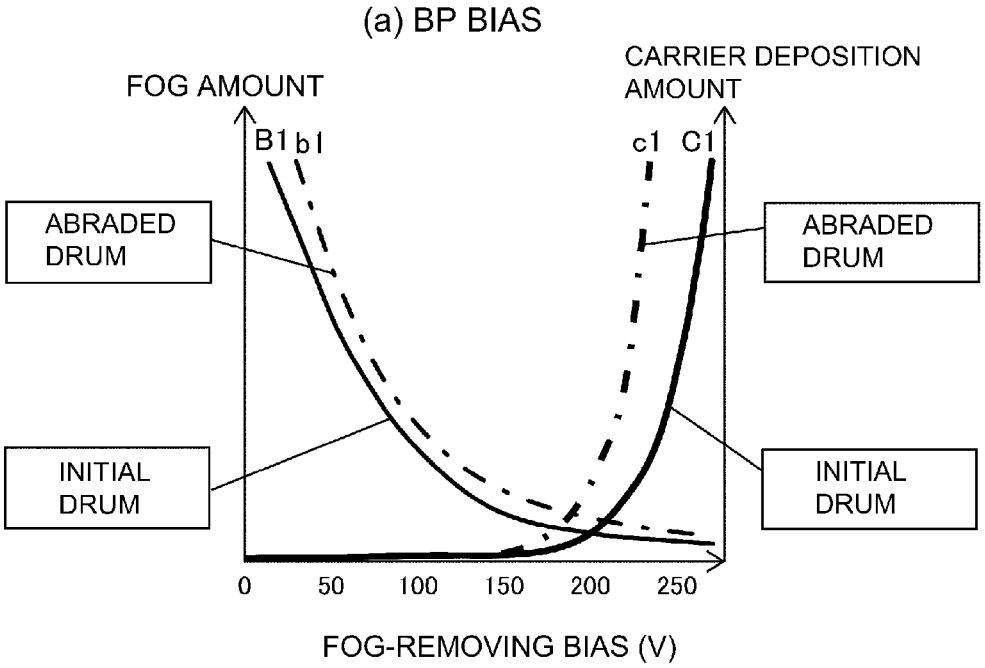
In FIG. 6, (a) is a graph showing an influence of the abrasion of the photosensitive drum on the fog amount and the carrier deposition amount in the case where the BP bias is used, and (b) is a graph showing an influence of the abrasion of the photosensitive drum on the fog amount and the carrier deposition amount in the case where the rectangular wave bias is used.
Figure 6:
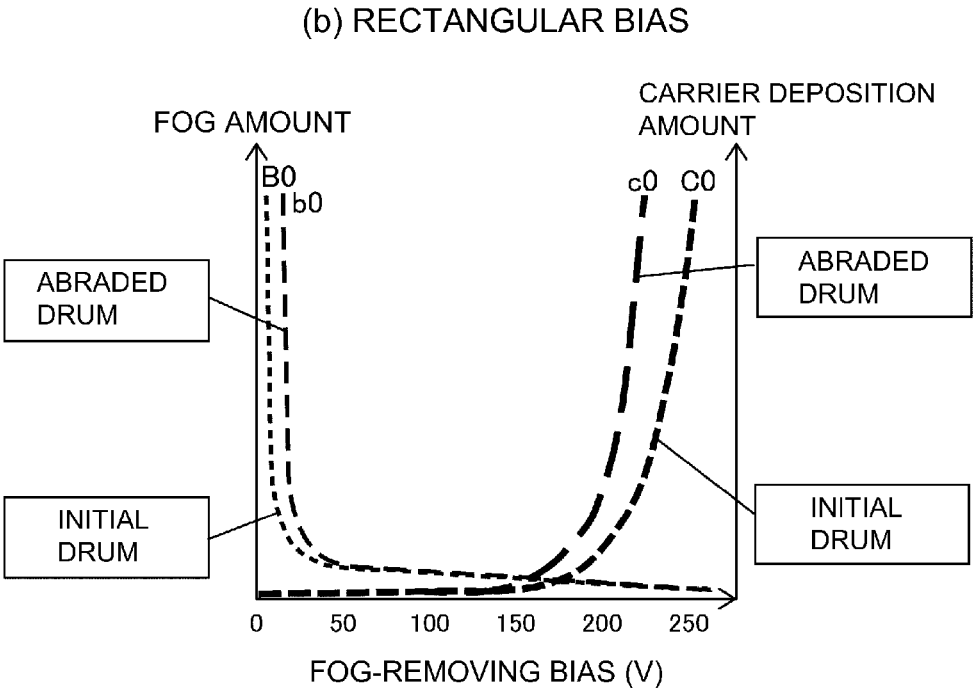

First, the influence on the developing property. The developing property refers to a magnitude of a developing contrast necessary to ensure a certain image density. As shown in FIG. 5, when the surface layer 1*s* is abraded and the electrostatic capacity becomes large, the image density increases compared with that in a state before the abrasion, irrespective of the waveform of the developing bias (a0>A0, a1>A1).

This is for the following reason. Of the region of the photosensitive drum 1, in the exposed region where the surface potential of the photosensitive drum 1 is discharged to the light-portion potential VL, the toner supplied from the developing sleeve 42 is deposited. The toner is charged to the negative polarity, and therefore, the potential in the exposed region lowers from the light-portion potential VL toward an average potential (Vdc) of the developing sleeve 42. At this time, with a larger electrostatic capacity, an amount of the electric charges necessary to lower the potential with a certain width (range) becomes larger, so that the toner deposition amount in the exposed region becomes large. As a result, a tendency that when the abrasion of the surface layer 1*s* progresses and the electrostatic capacity becomes larger, the image density with respect to the developing contrast becomes higher appears. Incidentally, it is known that in parallel to the abrasion of the photosensitive drum 1, also the carrier particles are gradually abraded and a charging performance thereof lowers, and there is a tendency that the charge amount of the toner per a certain weight lowers with a time. Such a lowering in toner charge amount increases the toner amount necessary to lower the potential in the exposed region, and therefore, acts in a direction of enhancing the image density similarly as in the case of the abrasion of the surface layer 1*s*.

On the other hand, when a degree of the abrasion of the photosensitive drum 1 is the same (degree), as described above, there is a tendency that the image density in the case of the BP bias is higher than the image density in the case of the rectangular wave bias (A1>A0, a1>a0). In summary, the evaluation of the developing property as shown in Table 1 is made.

Next, the influence of the abrasion of the photosensitive drum 1 on the fog amount and the carrier deposition amount will be described. As shown in (a) and (b) of FIG. 6, the influence of the abrasion of the photosensitive drum 1 on the fog amount is relatively small in both cases of the BP bias and the rectangular wave bias in common, and the fog amounts somewhat increase with progress of the abrasion (b1≥B1, b0≥B0).

Figure 7:
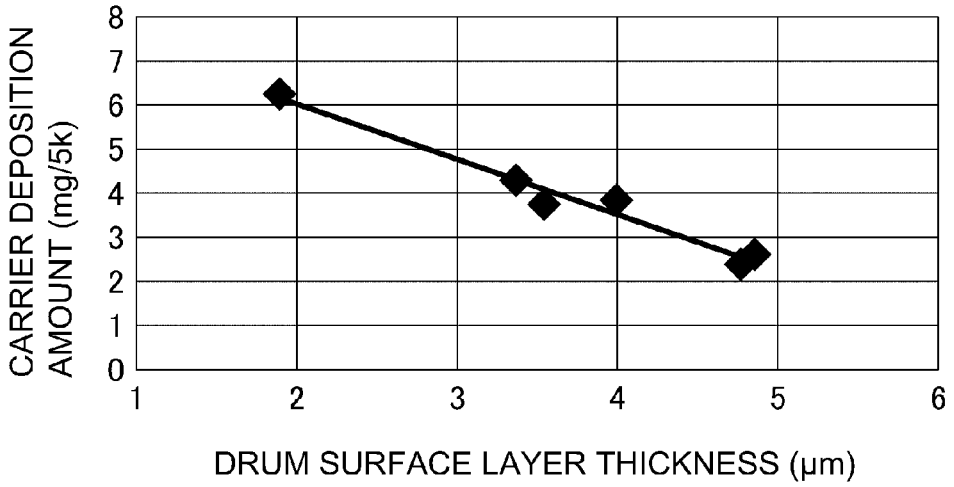
FIG. 7 is a graph showing a relationship between a surface layer thickness of the photosensitive drum and the carrier deposition amount onto the photosensitive drum.

On the other hand, in the abraded state of the photosensitive drum 1, compared with the initial state, the carrier deposition amounts increase (c1>C1, c0>C0). As shown in FIG. 7, when a relationship between the film thickness of the surface layer 1*s* and the carrier deposition amount per 5000 sheets on which the output images were formed was checked, there was a tendency that the carrier deposition amount on the photosensitive drum 1 increased with the abrasion of the surface layer 1*s*. This would be considered because the electrostatic capacity is increased by the abrasion of the surface layer 1*s* of the photosensitive drum 1 and the toner is liable to jump from the carrier carried on the developing sleeve 42, and thus the carrier is liable to be in a state in which the toner is removed from the carrier and thus the carrier is exposed.

Figure 8:
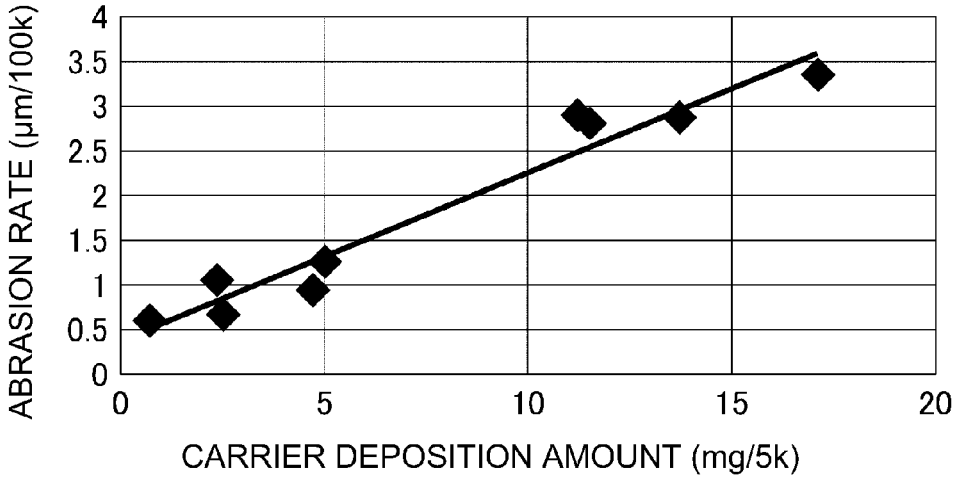
FIG. 8 is a graph showing a relationship between the carrier deposition amount onto the photosensitive drum and an abrasion rate of the photosensitive drum.

As shown in FIG. 8, when the carrier deposition amount increases, the carrier acts as an abrading material (abrasive) at a contact portion or the like with the cleaning blade 61, so that the abrasion rate of the surface layer 13*a* (i.e., a film thickness decreasing amount per 100,000 sheets on which the output images are formed) becomes large. That is, when the carrier deposition amount increases, the abrasion of the surface layer 1*s* is accelerated and constitutes a factor of lowering a lifetime of the photosensitive drum 1.

Here, the fog-removing bias in the BP bias has the redundancy of the settable range thereof lower than that in the rectangular wave bias, and therefore, is set at a large value to some extent. However, in the case where the BP bias is used in a state in which the photosensitive drum 1 is abraded to some extent or more, each of exposure of the carrier and the magnitude of the fog-removing bias act in combination, so that the carrier deposition amount exceeds a tolerable range (Table 1).

Accordingly, from the viewpoint of suppression of the carrier deposition, in the abraded state in which the abrasion of the photosensitive drum 1 progresses, the rectangular wave bias or the BP bias in which the blank portion is set at a short length may preferably be used.

Finally, the charging discharge amount which is a magnitude of a discharge current flowing between the charging roller 2 and the photosensitive drum 1 will be described. In general, as an absolute value of the dark-portion potential VD is set at a larger value, an amount of the electric charges to be supplied from the charging roller 2 to the photosensitive drum 1 becomes larger, so that a DC component (charging DC current) of the charging discharge amount as the discharge current flowing through the charging nip N2 increases. The amount of the discharge product increases with an increasing charging discharge amount, and therefore, from the viewpoints of suppressing the deterioration and abrasion of the photosensitive drum 1, the charging DC current may preferably be small.

The magnitude of the dark-portion potential VD is determined by the developing contrast and the fog-removing bias. Of these, a large developing contrast is needed in the initial state in which the photosensitive drum 1 is not abraded compared with the abraded state since the developing property is low. Further, since the rectangular wave bias is low in developing property compared with the BP bias, the rectangular wave bias requires a larger developing contrast. For this reason, in the case where the rectangular wave bias is used in the initial state, the developing contrast is set at a particularly large value compared with another case, so that the charging DC current increases (Table 1). Incidentally, as regards the fog-removing bias, contrary to the case of the developing contrast, a required value is smaller in the case of the rectangular wave bias, but it is known that the influence on the developing contrast is large, and therefore the above-described conclusion is unchanged.

Accordingly, from the viewpoint of suppression of the generation of the discharge product by reducing the charging discharge amount, in a state, inclusive of the initial state, in which the photosensitive drum 1 is not so abraded, it is preferable that the BP bias in which the blank portion is set at a long length is used.

Thus, when the film thickness change of the surface layer 1*s* by the abrasion of the photosensitive drum 1 is taken into consideration, it is preferable that the BP bias is used in the initial state and that the rectangular wave bias or the BP bias short in length of the blank portion is used in the abraded state.

Prediction of Surface Layer Thickness

Figure 9:
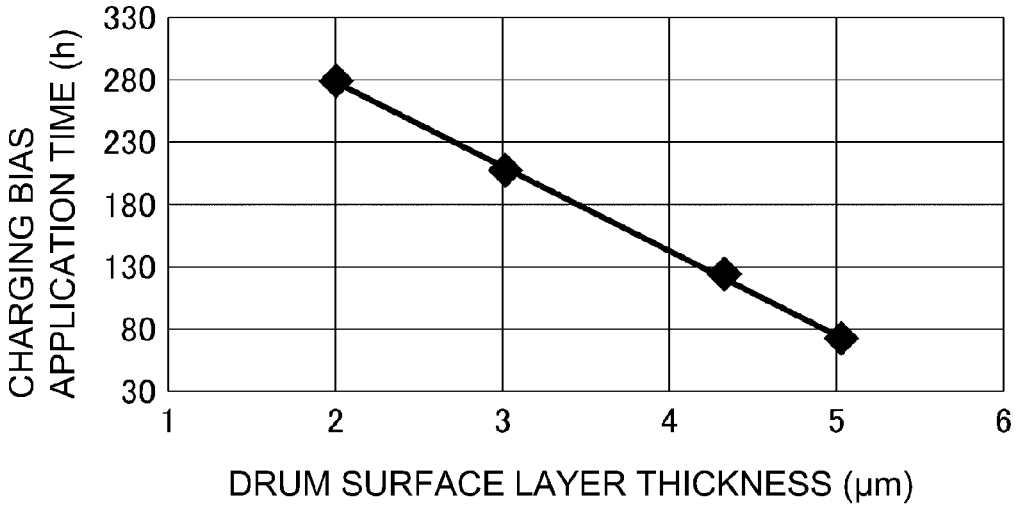
FIG. 9 is a graph showing a relationship between a cumulative time (charging application time), in which a charging bias is applied to a charging roller, and the surface layer thickness of the photosensitive drum.

Therefore, in this embodiment, the surface layer thickness of the photosensitive drum 1 is predicted from a charging application time which is a cumulative time in which the charging bias is applied to the charging roller 2 and determines a waveform of the developing bias. As shown in FIG. 9, the film thickness of the surface layer 1*s* of the photosensitive drum 1 linearly decreased with an increase in charging application time. Therefore, a threshold of the charging application time was stored in advance in storing device of the controller 101, and a charging application time from a start of use (e.g., at the time of exchange) of the photosensitive drum was compared with the threshold, so that the waveform of the developing bias was determined.

Figure 10:
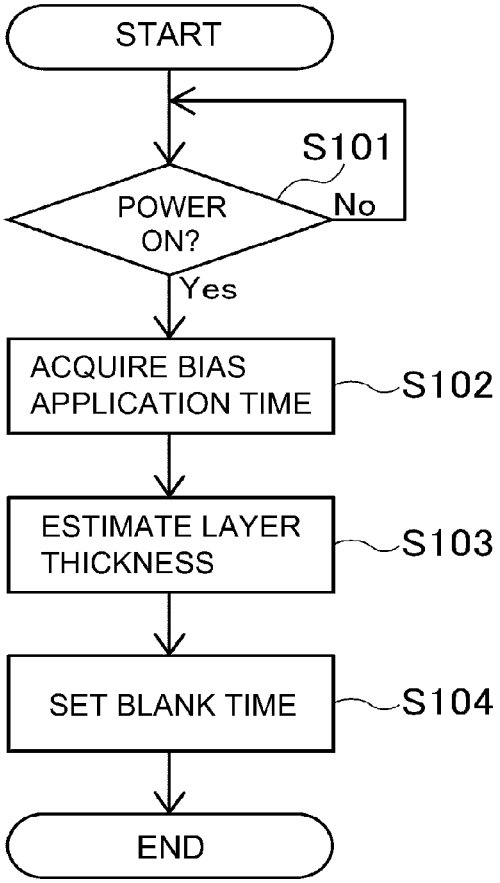
In FIG. 10, (a) is a flowchart showing a waveform control process of a developing bias in Embodiment 1, and (b) is a table showing a criterion (for evaluation) of a length of a blank portion.

A specific control process will be described. A selection of the waveform of the developing bias is executed during actuation of the image forming apparatus 100. As shown in (a) of FIG. 10, when a main switch of the apparatus main assembly is actuated (S101: Yes), the controller 101 acquires the charging application time stored in the storing device (S102). However, a value of the charging application time is renewed at any time during the actuation of the image forming apparatus 100 by making reference to a timer S2 (FIG. 2) by the controller 101. Then, for example, by making reference to a table showing a relationship between the charging application time and the surface layer thickness of the photosensitive drum 1, the surface layer thickness is predicted (S103), and on the basis of the predicted film thickness (surface layer thickness), the waveform of the developing bias is determined in accordance with a table shown in (b) of FIG. 10 (S104).

In the case where the charging application time is not more than 70 hours, the film thickness is predicted as being not less than 5 μm. In the case where the charging application time is longer than 208 hours, the film thickness is predicted as being less than 3 μm. Further, in the case where the charging application time is between these charging application times (thresholds), the film thickness is predicted as being not less than 3 μm and less than 5 μm. Further, in the case where the predicted film thickness is not less than 5 μm, the BP bias in which the length of the blank portion is a length corresponding to 8 (cyclic) periods in terms of the period of the oscillating portion is selected, and in the case where the predicted film thickness is not less than 3 μm and less than 5 μm, the BP bias in which the length of the blank portion is a length corresponding to 6 periods in terms of the period of the oscillating portion is selected. In the case where the predicted film thickness is less than 3 μm, the rectangular wave bias in which the length of the blank portion is zero is selected.

Thus, the waveform of the developing bias is set so that the blank portion becomes shorter with a longer charging application time. In other words, in the case where the surface layer 1*s* has a first thickness, a developing bias voltage in which an oscillating portion and a rest portion are alternately repeated is outputted. Further, in the case where the surface layer 1*s* has a second thickness smaller than the first thickness, a developing bias voltage in which the rest portion is not included or the rest portion is shorter than that in the case where the surface layer 1*s* has the first thickness is outputted. Incidentally, in this embodiment, description was made in such a manner that the controller 101 calculates the predicted film thickness, but the length of the blank portion may also be directly determined from the charging application time.

By the above-described control, in the case where the abrasion of the photosensitive drum 1 does not progress, the BP bias is used, and in the case where the abrasion of the photosensitive drum 1 has progressed, the developing bias is switched to the rectangular wave bias. As a result, in a state in which the film thickness is large, the BP bias is used, so that a good developing property can be obtained while suppressing the charging DC current (charging discharge amount). Further, in a state in which the film thickness is small, the rectangular wave bias is used, so that the carrier deposition can be suppressed. In other words, according to the control in this embodiment, the lifetime of the photosensitive drum 1 can be prolonged while satisfying basic performances such as ensuring of the image density and prevention of the fog.

Modified Embodiment

In Embodiment 1, the film thickness of the surface layer 1*s* is predicted from the charging application time, but may also be predicted from another numerical value correlated with a degree of the abrasion of the surface layer 1*s*. For example, a cumulative number of sheets on which the output images are formed may also be used, or a cumulative rotation time or a cumulative number of times of rotation of the photosensitive drum 1 may also be used. However, the charging application time has a strong correlation with the degree of the abrasion of the surface layer is (FIG. 9), so that in Embodiment 1, compared with the cases of the above-described factors, the film thickness of the surface layer 1*s* can be predicted with high accuracy.

Further, in the above, description that the electrostatic capacity of the photosensitive drum 1 is determined by the film thickness of the surface layer is was made, but in the case where the electrostatic capacity fluctuates due to another factor, the length of the blank portion may also be changed depending on the electrostatic capacity. That is, in the case where the surface layer 1*s* has a first electrostatic capacity, the BP bias may also be selected, and in the case where the surface layer 1*s* has a second electrostatic capacity smaller than the first electrostatic capacity, the rectangular wave bias or the BP bias short in length of the blank portion may also be selected. As a fluctuation factor of the electrostatic capacity, it is possible to cite a temperature condition in the case where the surface layer 1*s* is formed of a material which is relatively large in temperature dependency of dielectric constant.

Further, there is no need to limit timing, when the waveform of the developing bias is set, to the time of actuation of the image forming apparatus 100. For example, during the actuation of the image forming apparatus 100, the waveform of the developing bias may also be set again every predetermined operation time (such as every 100,000 sheets on which the output images are formed).

Embodiment 2

Another embodiment (Embodiment 2) in which control depending on the surface layer thickness of the photosensitive drum 1 is carried out will be described. This embodiment is different from the above-described Embodiment 1 in that the film thickness of the surface layer 1*s* is predicted from an amount of a current flowing between the charging roller 2 and the photosensitive drum 1. In the following, elements in common with those in Embodiment 1 are represented by the same reference numerals or symbols and will be omitted from description.

In the case where a charging bias in the form of a DC voltage biased with an AC voltage is applied to the charging roller 2, a current which is the sum of a component (charging DC current) resulting from the DC voltage and a component resulting from the AC voltage flows through the charging nip N2. Of these components, the charging DC current flows along a path ranging from the charging nip N2 to a grounded core shaft of the photosensitive drum 1 via the surface layer 1*s*, and is influenced by the film thickness of the surface layer 1*s*. That is, as shown in FIG. 11 as an empirical measurement result, there is a negative correlation between the charging DC current and the film thickness of the surface layer 1*s*.

Figure 11:
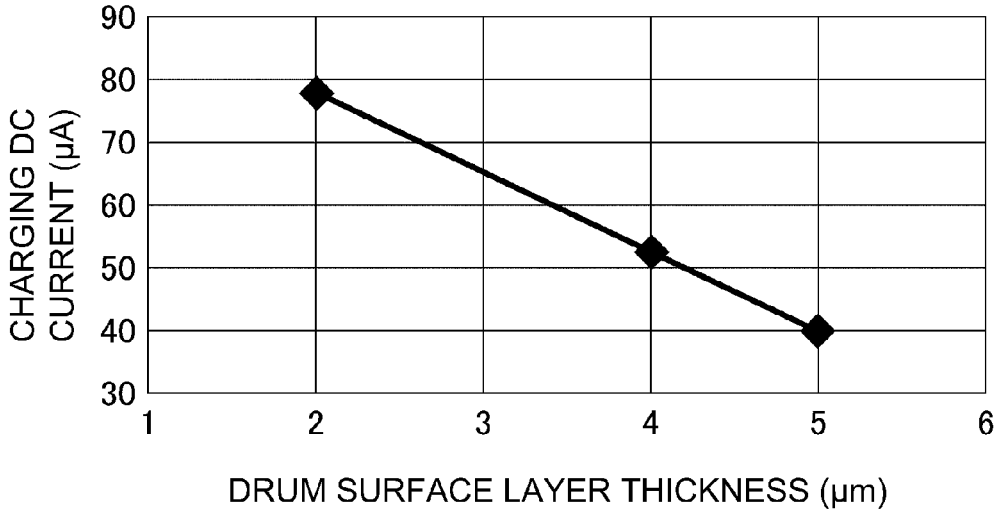
FIG. 11 is a graph showing a relationship between a DC component of a current (charging DC current), flowing through between a photosensitive drum and a charging roller, and the surface layer thickness of the photosensitive drum.

Therefore, in this embodiment, from the experiment result or the like as shown in FIG. 11, a relationship between the charging DC current and the film thickness of the surface layer 1*s* is obtained in advance, so that the surface layer thickness of the photosensitive drum 1 is predicted. That is, in this embodiment, the current detecting portion 202 (FIG. 2), of the charging bias voltage source P2, capable of detecting the magnitude of the charging DC current is used as a layer thickness detecting means for detecting the film thickness of the surface layer 1*s*.

Figure 12:
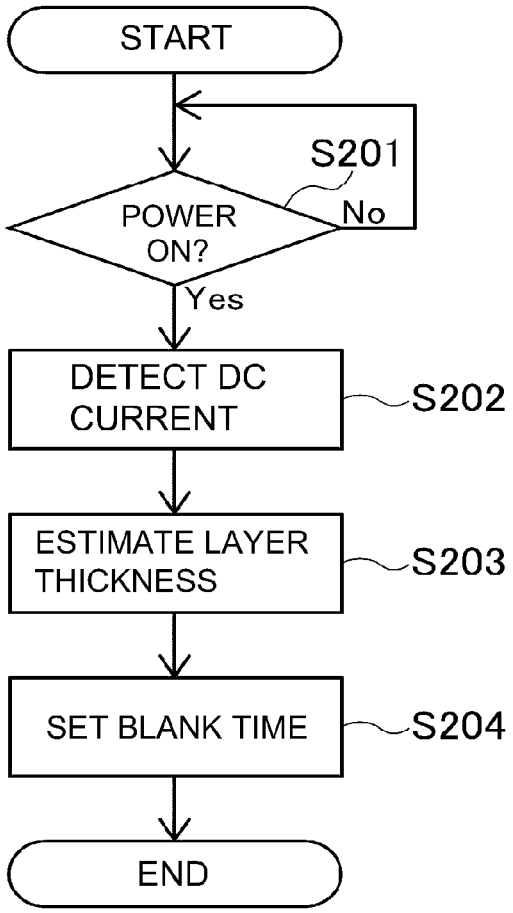
In FIG. 12, (a) is a flowchart showing a waveform control process of a developing bias in Embodiment 2, and (b) is a table showing a criterion (for evaluation) of a length of a blank portion.

A specific control process will be described. As shown in (a) of FIG. 12, when a main switch of the apparatus main assembly is actuated (S201: Yes), it causes the charging bias voltage source P2 to output the developing bias before the image forming operation is started and causes the current detecting portion to detect the charging DC current flowing through the charging nip N2 (S202). This charging bias includes an AC component having a magnitude enabling uniform charging, and for example, a charging bias in the form of a DC voltage of −600 V biased with an AC voltage of 1700 V in peak-to-peak voltage is used. Then, on the basis of a detection result of the charging DC current, by making reference to a preliminarily stored data showing a relationship between the charging DC current and the film thickness of the surface layer 1*s*, the film thickness is predicted (S203), and the waveform of the developing bias is determined in accordance with a table shown in (b) of FIG. 12 (S204).

In the case where the predicted film thickness based on a detected value of the charging DC current is not less than 5 μm, the length of the blank portion is set at a length corresponding to 8 (cyclic) periods in terms of the period of the oscillating portion, and in the case where the predicted film thickness is not less than 3 μm and less than 5 μm, the length of the blank portion is set at a length corresponding to 6 periods in terms of the period of the oscillating portion. In the case where the predicted film thickness is less than 3 μm, the length of the blank portion is set at zero.

Thus, the waveform of the developing bias is set so that the blank portion becomes shorter with a smaller predicted film thickness. That is, similarly as in Embodiment 1, in the case where the surface layer 1*s* has a first thickness, a developing bias voltage in which an oscillating portion and a rest portion are alternately repeated is outputted. Further, in the case where the surface layer 1*s* has a second thickness smaller than the first thickness, a developing bias voltage in which the rest portion is not included or the rest portion is shorter than that in the case where the surface layer 1*s* has the first thickness is outputted.

As a result, in the case where the abrasion of the photosensitive drum 1 does not progress, the BP bias is used, and in the case where the abrasion of the photosensitive drum 1 has progressed, the developing bias is switched to the rectangular wave bias. Accordingly, also in this embodiment, similarly as in Embodiment 1, the lifetime of the photosensitive drum 1 can be prolonged while satisfying basic performances such as ensuring of the image density and prevention of the fog.

However, in the case where this embodiment is compared with Embodiment 1, in this embodiment, the film thickness of the surface layer 1*s* is directly predicted by detecting the charging DC current, and therefore the film thickness can be detected further accurately. For example, between the case where a half-tone thin image is continuously outputted and the case where a solid image is continuously outputted, it would be considered that there arises a difference in abrasion rate of the surface layer 1*s* due to a difference in amount of a deposited matter (such as an external additive to the toner) onto the photosensitive drum 1. Even in such a case, according to this embodiment, the film thickness can be detected with high accuracy.

Incidentally, the layer thickness detecting means for detecting the film thickness of the surface layer 1*s* is not limited to the above-described current detecting portion 202, but another detecting means may also be used. For example, a constitution in which a thickness of the surface layer 1*s* is detected in the case where minute unevenness is formed on the surface of the photosensitive drum 1 may also be employed.

Embodiment 3

Influence of Change in Humidity Condition

In the above-described Embodiments 1 and 2, the waveform of the developing bias was selected depending on the thickness or the electrostatic capacity of the surface layer 1*s* of the photosensitive drum 1, but various influence appear also due to a humidity condition. Therefore, in this embodiment, the developing bias waveform is determined depending on the humidity condition in which the photosensitive drum 1 is placed. In the following, control in which as an index indicating the humidity, an absolute water content, i.e., weight-basis absolute humidity is used will be described, but other indices such as relative humidity and volume-basis absolute humidity may also be used. Incidentally, the image forming apparatus 100 includes a temperature and humidity sensor S1 (FIG. 2), capable of simultaneously detecting the temperature and the humidity, as a humidity detecting means for detecting the humidity in an inside of the apparatus. Elements in common with those in Embodiment 1 are represented by the same reference numerals or symbols and will be omitted from description.

Depending on the humidity in the inside of the apparatus, under application of the rectangular wave bias and the BP bias, influences shown in Table 2 below appear. Details of evaluations shown in Table 2 will be described in turn. However, as regards the developing property, the fog and the carrier deposition, the influence of the humidity thereon is relatively small, and the influence of the difference between the rectangular wave bias and the BP bias is large, and therefore description will be omitted.

TABLE 2

| | Item | WRB*1 | BPB*2 |
|---|---|---|---|
| (LHE*3) | DP*4 | ○ | ◎ |
| DSV:L | FOG | ◎ | Δ |
| DSR:L | CD*5 | ◎ | Δ (US*7) |
| | CDA*6 | Δ | Δ (US*7) |
| | DCI*8 | ◎ | ◎ |
| (HHE*9) | DP*4 | ○ | ◎ |
| DSV:S | FOG | ◎ | Δ |
| DSR:S | CD*5 | ◎ | Δ |
| | CDA*6 | ○ | ○ |
| | DCI*8 | US*7 | ○ |

*1"WRB" is the rectangular wave bias.
*2"BPB" is the BP bias.
*3"LHE" is a low humidity environment. "DSV" is the discharge start voltage, and "DSR" is the drum surface resistivity. "L" is large.
*4"DP" is the developing property.
*5"CD" is the carrier deposition.
*6"CDA" is the charging discharge amount.
*7"US" is an unsuitable state (evaluation).
*8"DCI" is developing (electric) charge injection.
*9"HHE" is a high humidity environment. "DSV" is the discharge start voltage, and "DSR" is the drum surface resistivity. "S" is small.

First, a relationship between the inside humidity of the apparatus and the magnitude of the AC component of the charging bias will be described. In the charging nip N2, electric discharge generates in the case where the charging bias is larger than the discharge start voltage. The AC component of the charging bias is in general set at a peak-to-peak voltage which is not less than twice the discharge start voltage so that the photosensitive drum 1 is uniformly charged by stably generating normal electric discharge and reverse electric discharge. Here, in the case where the inside humidity of the apparatus is low, the number of water molecules existing in the charging nip N2 is small, so that the discharge start voltage at the charging nip N2 increases. Accordingly, in the low humidity environment, compared with the high humidity environment, the peak-to-peak voltage is set at a large value. In this case, the charging discharge amount which is the sum of the DC component and the AC component during the electric discharge at the charging nip N2 becomes large compared with that in the high humidity environment.

Here, the BP bias is low in redundancy of the settable range of the fog-removing bias when compared with the rectangular wave bias ((b) of FIG. 4), so that the fog-removing bias which is large to some extent is set, and therefore, the carrier deposition generates to some extent. The amount of such a carrier deposition is in a tolerance range in the high humidity environment in which the charging discharge amount is relatively small. However, in the case where the BP bias is used in the low humidity environment, both of the charging discharge amount and the carrier deposition amount are in large states (Table 2). In this case, the surface layer 1*s* deteriorated by the discharge product is abraded by the carrier at the contact portion or the like with the cleaning blade 61, so that there is a liability that the abrasion rate of the photosensitive drum 1 becomes large.

Accordingly, from the viewpoint of suppressing the abrasion of the photosensitive drum 1, it is preferable that in the low humidity environment, the rectangular wave bias or the BP bias in which the length of the blank portion is set at a short value is used.

Next, a relationship between the inside humidity of the apparatus and a phenomenon (developing (electric) charge injection) that the electric charges are injected from the developing sleeve 42 into the photosensitive drum 1 will be described. When the inside humidity of the apparatus is high, water content is deposited on the surface layer 1*s* of the photosensitive drum 1, so that the surface resistivity lowers. Then, the electric charges are injected from the developing sleeve 42, to which the developing bias is applied, into a low surface resistivity portion of the photosensitive drum 1, so that the electric charges are moved irrespective of movement of the toner (particles). When the electrostatic latent image on the photosensitive drum 1 is disturbed by such electric charge injection, an image defect called image flow (deletion) such as disappearance of dots or blurring of a contour portion generates.

Figure 13:
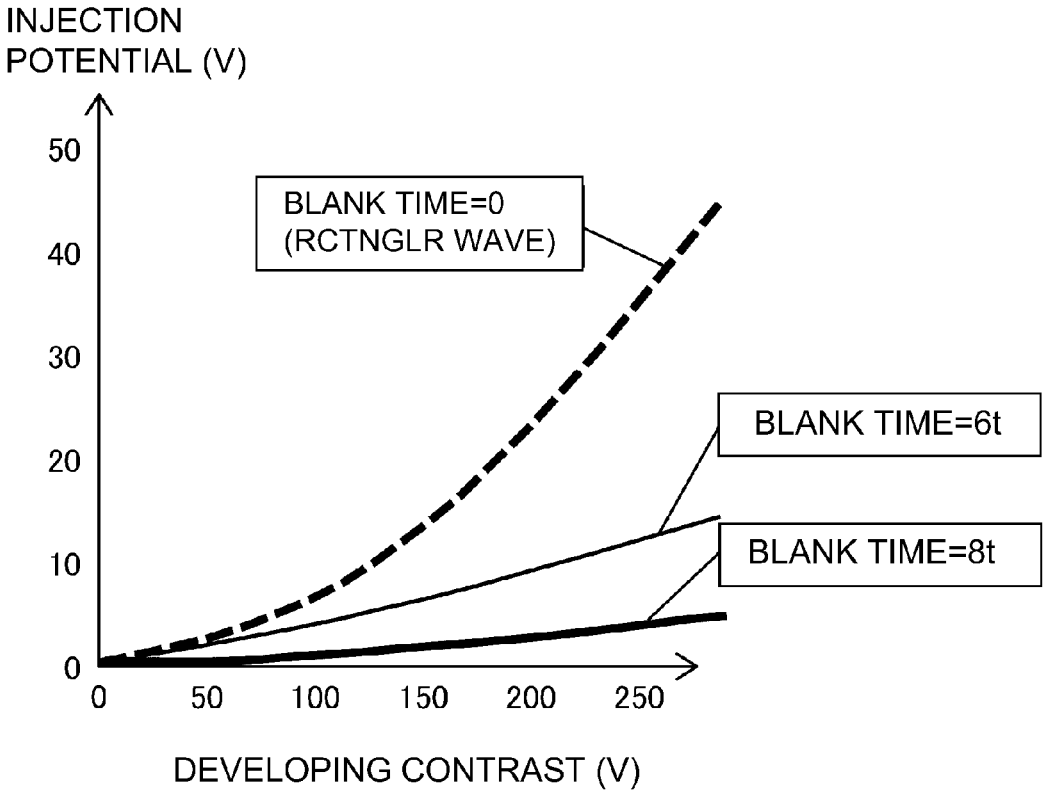
FIG. 13 is a graph showing a relationship between the length of the blank portion and an amount of electric charge injection from a developing sleeve into a photosensitive drum.

A graph of FIG. 13 shows a relationship between the developing bias waveform and a change amount (injection potential) of a potential by electric charge injection in an environment in which the absolute water content is larger than 10 g/kgDA. As is apparent from comparison among curves in the figure, the electric charge injection is suppressed with a longer length of the blank portion of the developing bias, and on the other hand, under application of the rectangular wave bias, relatively large electric charge injection generates (Table 2). This is considered because the electric charge injection generates in the case where a difference between the applied voltage to the developing sleeve 42 and the light-portion potential VL is large, and therefore, the electric charge injection is suppressed at the rest portion.

Accordingly, from the viewpoint of improvement in image quality by suppressing the electric charge injection, in the high humidity environment, the BP bias in which the length of the blank portion is set at a long value may preferably be used.

Detection of Absolute Water Content

Figure 14:
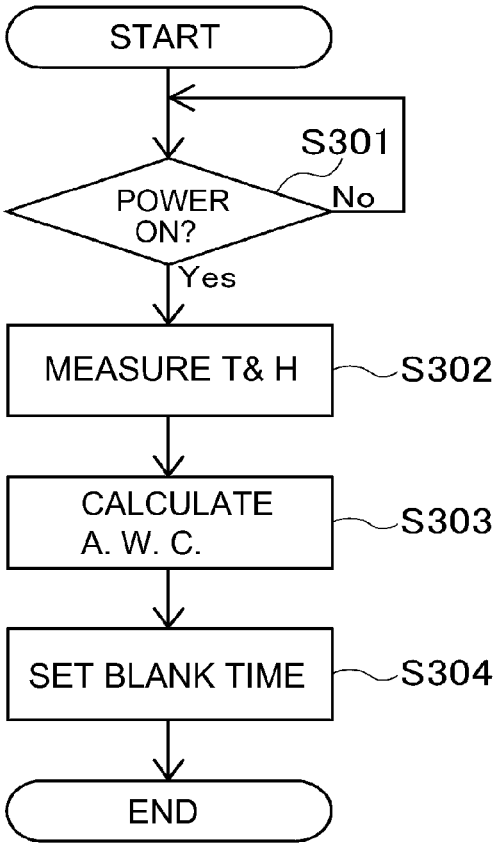
In FIG. 14, (a) is a flowchart showing a waveform control process of a developing bias in Embodiment 3, and (b) is a table showing a criterion (for evaluation) of a length of a blank portion.

Therefore, in this embodiment, the developing bias waveform is determined by calculating the absolute water content by using the temperature and humidity sensor S1. A selection of the waveform of the developing bias is executed during actuation of the image forming apparatus 100. As shown in (a) of FIG. 14, when a main switch of the apparatus main assembly is actuated (S301: Yes), the controller 101 acquires values of current temperature and current relative humidity by detection signals from the temperature and humidity sensor S1 (S302), and calculates the absolute water content (S303). Then, on the basis of the calculated value of the absolute water content, the waveform of the developing bias is determined in accordance with a table shown in (b) of FIG. 14 (S304).

In the case where the absolute water content is not more than 5 g/kgDA, the length of the blank portion is set at zero, and in the case where the absolute water content is larger than 5 g/kgDA and not less than 10 g/kgDA, the length of the blank portion is set at a length corresponding to 6 periods in terms of the period of the oscillating portion. In the case where the absolute water content is larger than 10 g/kgDA, the length of the blank portion is set at a length corresponding to 8 periods in terms of the period of the oscillating portion.

Thus, the waveform of the developing bias is set so that the blank portion becomes longer with a larger absolute water content (higher humidity). In other words, in the case where the apparatus inside humidity is a first humidity, a developing bias voltage in which an oscillating portion and a rest portion are alternately repeated is outputted. Further, in the case where the apparatus inside humidity is a second humidity smaller than the first humidity, a developing bias voltage in which the rest portion is not included or the rest portion is shorter than that in the case where the surface layer 1*s* has the first humidity is outputted.

By the above-described control, in the case where the photosensitive drum 1 is in the high humidity environment, the BP bias is used, and in the case where the photosensitive drum 1 is in the low humidity environment, the rectangular wave bias is used. As a result, in the high humidity environment, the BP bias is used, so that the electric charge injection is suppressed and thus the image quality can be improved. Further, in the low humidity environment, the rectangular wave bias is used, so that the carrier deposition is suppressed, and even when an amplitude of the AC component of the developing bias is increased, an increase in abrasion rate of the photosensitive drum 1 can be prevented. In other words, according to the control in this embodiment, the abrasion rate of the photosensitive drum 1 can reduce the image quality through the high humidity environment and the low humidity environment.

Embodiment 4

In the above-described Embodiment 3, the electric charge injection in the high humidity environment was noticed, but is generated by a factor other than the humidity, i.e., also in the case where the surface resistivity of the photosensitive drum 1 is lowered. Therefore, in this embodiment, a change in surface resistivity of the photosensitive drum 1 is detected from an amount of a current flowing between the charging roller 2 and the photosensitive drum 1. In the following, elements in common with those in Embodiment 1 are represented by the same reference numerals or symbols and will be omitted from description.

Figure 15:
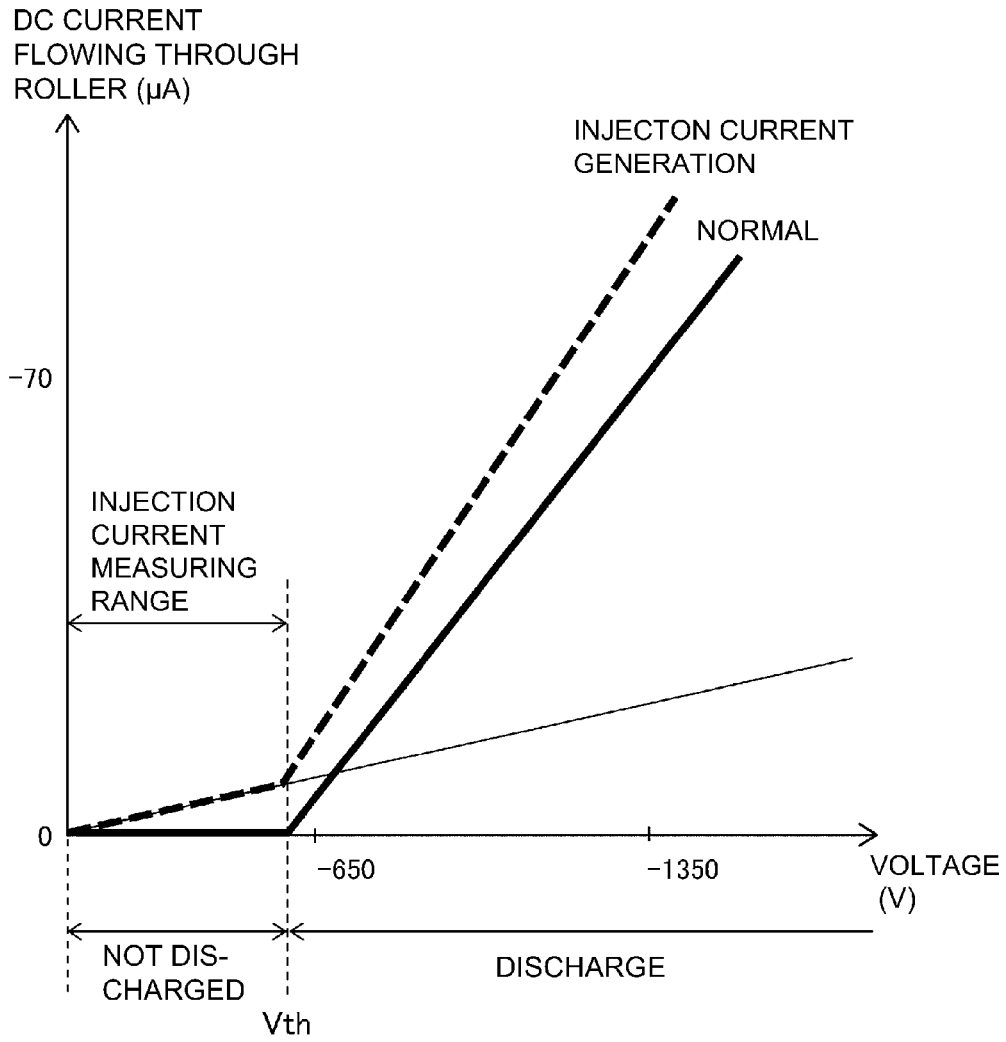
FIG. 15 is a graph showing a magnitude of a DC voltage applied to a charging roller and a magnitude of a current flowing through between the charging roller and a photosensitive drum.

FIG. 15 shows an amount of a current flowing through the charging roller 2 in the case where a bias voltage including only a DC contact is applied to the charging roller 2. In general, under application of the bias voltage in an undischarged region lower than a discharge start voltage Vth, the electric discharge at the charging nip N2 does not generate, so that a direct current is not detected. However, in the case where the surface resistivity locally lowers, even in the undischarged region, the electric charge injection from the charging roller 2 into the photosensitive drum 1 generates, whereby the current flows. Accordingly, it becomes possible to detect a change in surface resistivity of the photosensitive drum 1 by measuring a current (charging injection current flowing through the charging nip N2 in a state in which the DC voltage lower than the discharge start voltage Vth is applied to the charging roller 2. That is, in this embodiment, the current detecting portion 202 (FIG. 2), of the charging bias voltage source P2, capable of detecting the charging injection current is used as a resistance detecting means for detecting the change in surface resistivity of the photosensitive drum 1.

Figure 16:
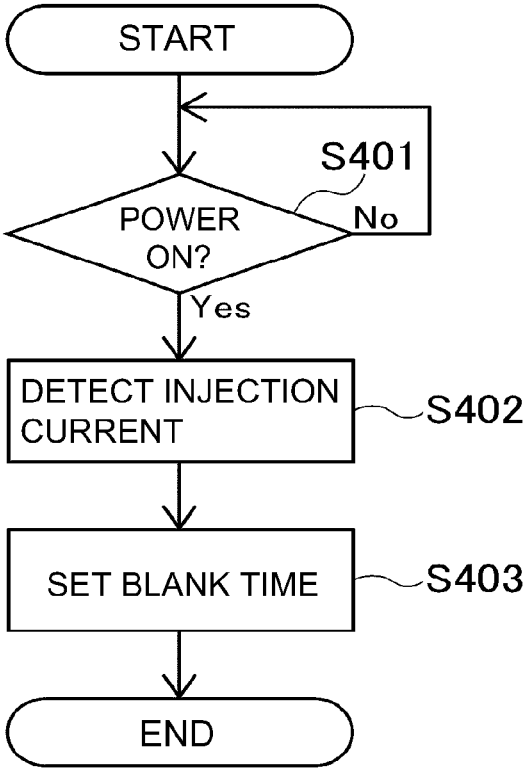
In FIG. 16, (a) is a flowchart showing a waveform control process of a developing bias in Embodiment 4, and (b) is a table showing a criterion of a length of a blank portion.

A specific control process will be described. As shown in (a) of FIG. 16, when a main switch of the apparatus main assembly is actuated (S401: Yes), it causes the charging bias voltage source P2 to output a predetermined DC voltage before the image forming operation is started and causes the current detecting portion to detect the charging injection current flowing through the charging nip N2 (S402). This DC waveform is a voltage smaller in absolute value than the discharge start voltage Vth. For example, in an example shown in FIG. 15, Vth=600 V, and therefore a DC voltage of 500 V is used. Then, on the basis of a detected value of the charging injection current, the waveform of the developing bias is determined in accordance with a table shown in (b) of FIG. 16 (S403).

In the case where the charging injection current is less than 0.5 μA, the length of the blank portion is set at zero. In the case where the charging injection current is not less than 0.5 μA and less than 1 μA, the length of the blank portion is set at a length corresponding to 6 periods in terms of the period of the oscillating portion. In the case where the charging injection current is not less than 1 μA, the length of the blank portion is set at a length corresponding to 8 periods in terms of the period of the oscillating portion.

Thus, the waveform of the developing bias is set so that the blank portion becomes longer with a larger injection current based on a smaller surface resistivity. In other words, in the case where the surface resistivity of the photosensitive drum 1 is a first value, a developing bias voltage in which an oscillating portion and a rest portion are alternately repeated is outputted. Further, in the case where the surface resistivity of the photosensitive drum 1 is a second value smaller than the first value, a developing bias voltage in which the rest portion is not included or the rest portion is shorter than that in the case where the surface layer 1*s* has the first value is outputted.

As a result, in the case where the surface resistivity of the photosensitive drum 1 is relatively small, the BP bias is used, so that the electric charge injection by the developing sleeve 42 is suppressed and thus the image quality can be improved. Further, in the case where the surface resistivity of the photosensitive drum 1 is relatively large, the rectangular wave bias is used, so that the carrier deposition is suppressed, and even when an amplitude of the AC component of the developing bias is increased, an increase in abrasion rate of the photosensitive drum 1 can be prevented. Accordingly, similarly as in Embodiment 3, the control of the developing bias waveform depending on the humidity can be effected and the abrasion rate of the photosensitive drum 1 can reduce the image quality through the high humidity environment and the low humidity environment.

Further, in the case where this embodiment is compared with Embodiment 3, in this embodiment, the change in surface resistivity of the photosensitive drum 1 is detected by detecting the injection current by the charging roller 2, and therefore, it is possible to deal with the case where the electric charge injection by the developing sleeve 42 is generated due to a factor other than humidity. That is, it would be considered that although the humidity is low, the surface resistivity of the photosensitive drum 1 is locally lowered by the influence of the discharge product or the like and thus the electric charge injection by the developing sleeve 42 generates. In such a case, it would also be considered that the amplitude of the AC component of the charging bias is kept large, but the BP bias is used intentionally, so that it becomes possible to give priority to prevention of the image defect due to the electric charge injection.

Incidentally, the surface resistivity of the photosensitive drum 1 may also be detected by the resistance detecting means other than the above-described current detecting portion 202. For example, the amount of the injection current from the developing sleeve 42 into the photosensitive drum 1 may also be measured by the current detecting portion 402 of the developing bias voltage source P4. However, in this embodiment, the charging injection current is measured, and therefore, compared with the constitution using the current detecting portion 402, it is possible to accurately detect the surface resistivity without being influenced by electric charge movement by the toner.

Embodiment 5

In the above, description was made as to the control of the developing bias waveform depending on the surface layer thickness of the photosensitive drum 1 and the control of the developing bias waveform depending on the environment condition in which the photosensitive drum 1 is placed, but these can be used in combination. In this embodiment, not only the surface layer thickness is predicted from the charging application time (Embodiment 1) but also the absolute water content in the inside of the apparatus is measured (Embodiment 3), so that the developing bias waveform is determined.

Figure 17:
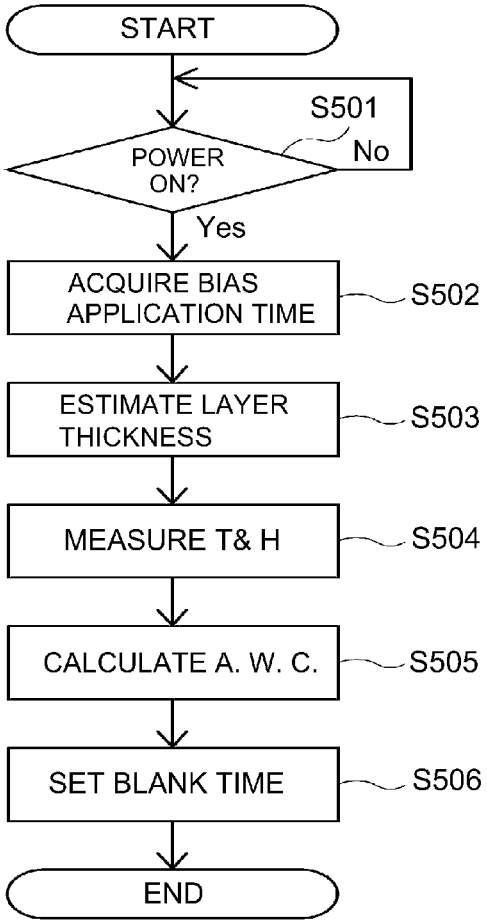
In FIG. 17, (a) is a flowchart showing a waveform control process of a developing bias in Embodiment 5, and (b) is a table showing a criterion (for evaluation) of a length of a blank portion.

A specific control process will be described. A selection of the developing bias waveform is executed during actuation of the image forming apparatus 100. As shown in (a) of FIG. 17, when a main switch of the apparatus main assembly is actuated (S501: Yes), the controller 101 acquires the charging application time stored in the storing device (S502) and predicts the surface layer thickness of the photosensitive drum 1 (S503). Further, the controller 101 acquires values of a current temperature and a current relative humidity by detection signals from the temperature and humidity sensor S1 (S504) and calculates the absolute water content (S505). Then, on the basis of the predicted film thickness and the calculated value of the absolute water content, the controller 101 determines the developing bias waveform in accordance with a table shown in (b) of FIG. 17 (S506).

Thus, in this embodiment, the developing bias waveform is determined so that the blank portion is shortened with a smaller absolute water content and simultaneously so that the blank portion is shortened with a longer charging application time. In other words, in waveform control of the developing bias depending on the absolute water content, in the case where the charging application time is a second length longer than a first length, the length of the blank portion is made not more than the length in the case where the charging application time is the first length. This means that in the case where the thickness of the surface layer 1*s* of the photosensitive drum 1 is a second thickness smaller than a first thickness, the length of the blank portion is made not more than the length in the case where the thickness of the surface layer 1*s* is the first thickness.

As a result, the image forming apparatus 100 in this embodiment can simultaneously obtain the effects of the above-described Embodiments 1 and 3. That is, it is possible to ensure a good developing property while suppressing the amount of the charging DC current in the case where the film thickness is large and to suppress the carrier deposition in the case where the film thickness is small. Further, it is possible to improve the image quality by suppressing the electric charge injection in the high-humidity environment and to prevent an increase in abrasion rate of the photosensitive drum 1 by suppressing the carrier deposition in the low-humidity environment.

Embodiment 6

Another embodiment in which the control of the developing bias waveform depending on the surface layer thickness of the photosensitive drum 1 and the control of the developing bias waveform depending on the environment condition are combined will be described. In this embodiment, not only the surface layer thickness is predicted from the charging DC current (Embodiment 2) but also the change in surface resistivity of the photosensitive drum 1 is detected from the charging injection current (Embodiment 4), so that the developing bias waveform is determined.

Figure 18:
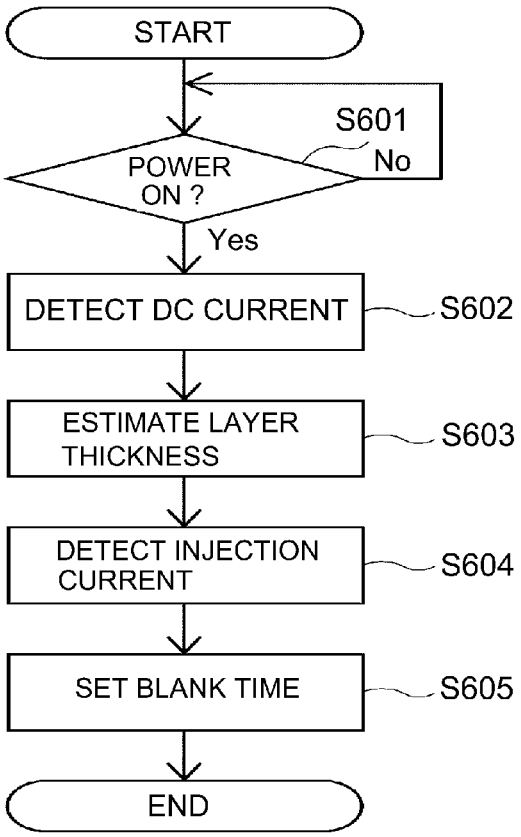
In FIG. 18, (a) is a flowchart showing a waveform control process of a developing bias in Embodiment 6, and (b) is a table showing a criterion of a length of a blank portion.

A specific control process will be described. A selection of the developing bias waveform is executed during actuation of the image forming apparatus 100. As shown in (a) of FIG. 18, when a main switch of the apparatus main assembly is actuated (S601: Yes), the controller 101 outputs the charging bias to the charging bias voltage source P2 before the image forming operation is started. This charging bias includes an AC component having a magnitude enabling uniform charging. Then, the charging DC current flowing thickness in the charging nip N2 is detected (S602), so that the surface layer thickness of the photosensitive drum 1 is predicted (S603). Further, the controller 101 causes the developing bias voltage source P2 to output a predetermined DC voltage, so that the charging injection current flowing thickness in the charging nip N2 (S604). This DC voltage is smaller in absolute value than the discharge start voltage. Then, on the basis of the predicted film thickness and the detected value of the charging injection current, the controller 101 determines the developing bias waveform in accordance with a table shown in (b) of FIG. 18 (S605).

Thus, in this embodiment, the developing bias waveform is determined so that the blank portion is shortened with a larger charging injection current (smaller surface resistivity) and simultaneously so that the blank portion is shortened with a larger charging DC current (smaller surface layer thickness). In other words, in waveform control of the developing bias depending on the absolute water content, in the case where the thickness of the surface layer 1*s* of the photosensitive drum 1 is a second thickness smaller than a first thickness, the length of the blank portion is made not more than the length in the case where the thickness of the surface layer 1*s* is the first thickness.

As a result, the image forming apparatus 100 in this embodiment can simultaneously obtain the effects of the above-described Embodiments 2 and 4. That is, it is possible to ensure a good developing property while suppressing the amount of the charging DC current in the case where the film thickness is large and to suppress the carrier deposition in the case where the film thickness is small. Further, it is possible to improve the image quality by suppressing the electric charge injection in the high-humidity environment and to prevent an increase in abrasion rate of the photosensitive drum 1 by suppressing the carrier deposition in the low-humidity environment.

Further, in this embodiment, the current detecting portion 202 of the charging bias voltage source P2 is caused to also function as the layer thickness detecting means for detecting the surface layer thickness of the photosensitive drum 1 and as the resistance detecting means for detecting the change in surface resistivity of the photosensitive drum 1. For this reason, the waveform control depending on information of the two types can be realized with a simple constitution.

Incidentally, a method of combining the developing bias waveform control portion the surface layer thickness with the developing bias waveform control depending on the environment condition is not limited to the above-described method, but it is possible to employ arbitrary combinations of Embodiments 1 and 2, modified embodiments thereof, Embodiments 3 and 4 are modified embodiments thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-093354 filed on May 6, 2016, which is hereby incorporated by reference herein in its entirety.

What is claimed is:

1. An image forming apparatus comprising:

a photosensitive member including a photosensitive layer and a surface layer formed on an outer periphery side of said photosensitive layer;

a charging member configured to electrically charge a surface of said photosensitive member by being supplied with a charging bias voltage;

an exposure member configured to expose said photosensitive member to light to form an electrostatic latent image;

a rotatable developer carrying member configured to carry a developer containing toner;

a voltage source configured to apply, to said developer carrying member, a developing bias voltage including a DC component and an AC component to develop the electrostatic latent image on said photosensitive member with the toner; and a controller configured to control said voltage source so that when a thickness of the surface layer of said photosensitive member is a first thickness, a developing bias voltage including an oscillating portion having an oscillating voltage and a rest portion having a substantially constant voltage alternately repeated is outputted, and so that when the thickness of the surface layer of said photosensitive member is a second thickness smaller than the first thickness, a developing bias voltage in which the rest portion is not included or is shorter than the rest portion when the thickness of the surface layer is the first thickness is outputted.

2. An image forming apparatus according to claim 1, further comprising a layer thickness detecting portion capable of detecting the thickness of the surface layer of said photosensitive member.

3. An image forming apparatus according to claim 1, wherein said charging member contacts the surface of said photosensitive member, wherein said image forming apparatus further comprises a current detecting portion capable of detecting a DC component of a current flowing between said photosensitive member and said charging member, and wherein said controller controls said voltage source on the basis of a detection result of said current detecting portion.

4. An image forming apparatus according to claim 1, wherein said oscillating portion is a rectangular wave of 2-20 kHz in frequency, and wherein said voltage source is capable of outputting a first developing bias voltage in which a length of the rest portion is not less than six periods of the oscillating portion and a second developing bias voltage including no rest portion.

5. An image forming apparatus according to claim 4, wherein said voltage source is capable of outputting a third developing bias voltage in which the length of the rest portion is longer than that of the first developing bias voltage.

6. An image forming apparatus comprising:

a photosensitive member including a photosensitive layer and a surface layer formed on an outer periphery side of said photosensitive layer;

a charging member configured to electrically charge a surface of said photosensitive member by being supplied with a charging bias voltage;

an exposure member configured to expose said photosensitive member to light to form an electrostatic latent image;

a rotatable developer carrying member configured to carry a developer containing toner;

a voltage source configured to apply, to said developer carrying member, a developing bias voltage including a DC component and an AC component to develop the electrostatic latent image on said photosensitive member with the toner; and a controller configured to control said voltage source so that when a current application time of the charging bias voltage is a first length, a developing bias voltage including an oscillating portion having an oscillating voltage and a rest portion having a substantially constant voltage alternately repeated is outputted, and so that when the current application time is a second length longer than the first length, a developing bias voltage in which the rest portion is not included or is shorter than the rest portion when the current application time is the first length is outputted.

7. An image forming apparatus comprising:

a photosensitive member including a photosensitive layer and a surface layer formed on an outer periphery side of said photosensitive layer;

a charging member configured to electrically charge a surface of said photosensitive member by being supplied with a charging bias voltage;

an exposure member configured to expose said photosensitive member to light to form an electrostatic latent image;

a rotatable developer carrying member configured to carry a developer containing toner;

a voltage source configured to apply, to said developer carrying member, a developing bias voltage including a DC component and an AC component to develop the electrostatic latent image on said photosensitive member with the toner; and a controller configured to control said voltage source so that when an electrostatic capacity of the surface layer of said photosensitive member is a first electrostatic capacity, a developing bias voltage including an oscillating portion having an oscillating voltage and a rest portion having a substantially constant voltage alternately repeated is outputted, and so that when the electrostatic capacity of the surface layer of said photosensitive member is a second electrostatic capacity larger than the first electrostatic capacity, a developing bias voltage in which the rest portion is not included or is shorter than the rest portion when the electrostatic capacity of the surface layer is the first electrostatic capacity is outputted.

* * * * *